US007510178B2

(12) United States Patent
Miyazaki et al.

(10) Patent No.: US 7,510,178 B2
(45) Date of Patent: Mar. 31, 2009

(54) SHEET-HANDLING DEVICE

(75) Inventors: Masahiko Miyazaki, Osaka (JP); Masuo Kawamoto, Osaka (JP); Mitsutoshi Takemoto, Osaka (JP); Takeshi Matsuo, Osaka (JP); Tetsuya Taguchi, Osaka (JP); Keisuke Egawa, Osaka (JP)

(73) Assignee: Kyocera Mita Corporation, Osaka (JP)

( * ) Notice: Subject to any disclaimer, the term of this patent is extended or adjusted under 35 U.S.C. 154(b) by 174 days.

(21) Appl. No.: 11/385,710

(22) Filed: Mar. 22, 2006

(65) Prior Publication Data

US 2006/0220304 A1 Oct. 5, 2006

(30) Foreign Application Priority Data

Mar. 29, 2005 (JP) ..... 2005-095578

(51) Int. Cl.
*B65H 37/04* (2006.01)

(52) U.S. Cl. ..... 270/58.1; 270/58.07; 270/58.08; 270/58.09; 270/58.11; 270/58.14

(58) Field of Classification Search ..... 270/58.07, 270/58.08, 58.09, 58.1, 58.11, 58.14
See application file for complete search history.

(56) References Cited

U.S. PATENT DOCUMENTS

| | | | | |
|---|---|---|---|---|
| 5,112,034 | A * | 5/1992 | Uto et al. | 270/58.12 |
| 5,765,824 | A | 6/1998 | Kawano et al. | |
| 6,375,180 | B1 * | 4/2002 | Kawano et al. | 270/58.09 |
| 6,375,181 | B1 * | 4/2002 | Kawano et al. | 270/58.12 |
| 2003/0214091 | A1 * | 11/2003 | Suzuki et al. | 270/17 |
| 2004/0181308 | A1 * | 9/2004 | Hayashi et al. | 700/223 |

FOREIGN PATENT DOCUMENTS

| | | |
|---|---|---|
| EP | 315 734 | 5/1989 |
| JP | 6-99070 | 12/1994 |
| JP | 2541979 | 7/1996 |
| JP | 09-235069 | 9/1997 |

* cited by examiner

*Primary Examiner*—Gene Crawford
*Assistant Examiner*—Leslie A Nicholson, III
(74) *Attorney, Agent, or Firm*—Smith, Gambrell & Russell LLP

(57) ABSTRACT

A sheet-handling device comprising an intermediate conveyer passage, an intermediate tray, introduction rollers, conveying rollers and a controller. The controller rotates the introduction rollers and the conveying rollers forward and reverse so as to convey two pieces of sheets successively introduced into the intermediate conveyer passage until their trailing ends separate away from the introduction rollers. The conveying rollers are halted in a state where the leading ends are nipped. After the leading ends of the two pieces of sheets have been nipped in an overlapped manner by the conveying rollers, the conveying rollers are rotated forward to convey the two pieces of overlapped sheets into the intermediate tray.

7 Claims, 16 Drawing Sheets

SHEET-HANDLING DEVICE

BACKGROUND OF THE INVENTION

1. Field of the Invention

The present invention relates to a sheet-handling device mounted on the body of an image-forming machine such as an electrostatic copier or a printer, to handle a sheaf of sheets formed by being introduced from the body of the image-forming machine or, more concretely, to handle the sheets, such as sorting, stapling and punching, and, then, to discharge the sheets onto a discharge tray for sorting.

2. Description of the Prior Art

A sheet-handling device mounted on the body of a copier is generally so constituted as to convey the sheets introduced from the body of the copier to an intermediate tray, form a sheaf of sheets on the intermediate tray, and discharge the sheets onto a discharge tray for sorting. While the sheet is being handled to form a sheaf of sheets on the intermediate tray, it is not allowed to convey the succeeding sheet into the intermediate tray. During this period, therefore, the copying operation of the copier must be discontinued. Discontinuation of the copying operation not only decreases the production efficiency of the sheet-handling device but also decreases the production efficiency of the whole system inclusive of the copier.

Sheet-handling devices aimed at overcoming a decrease in the production efficiency have already been proposed as taught in, for example, Japanese Patent No. 2541979, JP-B-06-099070 and JP-A-09-235069.

A sheet-handling device disclosed in Japanese Patent No. 2541979 is so constituted as to have a sheet discharged from an image-forming machine stay in a conveyer passage by controlling conveyer means while a stapler is executing the stapling. What is aimed at by this device is to minimize or eliminate the loss time in the image-forming operation even when the sheets are being stapled on a tray. In this device, however, only a piece of sheet is allowed to stay in the conveyer passage while the stapler is executing the stapling, but the second and subsequent sheets cannot be conveyed causing, therefore, the image-forming operation to be discontinued.

A sheet-handling device disclosed in JP-B-06-099070 includes first and second sheet conveyer paths for guiding the sheet to a sheet-handling tray, and change-over means which is so changed over that the sheet is sent into either the first sheet conveyer path or the second sheet conveyer path. The first and second sheets are sent into the second and first sheet conveyer paths so as to stay therein by changing over the change-over means even while the sheet-handling means is executing the sheet-handling operation for the sheaf of sheets on the handling tray. After the sheet handling has been finished, the first and second sheets are sent in an overlapped state onto the sheet-handling tray. What is aimed at by this device is to eliminate the loss time and, hence, to improve the productivity by feeding the sheets without waiting time. However, this device must be provided with change-over means for standing by in addition to the two sheet conveyer paths, resulting in an increase in the size of the constitution and in the cost, and making it difficult to cope with the jamming. Besides, up to two pieces of sheets are permitted to stand by. Three pieces can be made to stand by requiring, however, the provision of three sheet conveyer paths, which results in a further increase in the size of the constitution and in the cost, and making it further difficult to cope with the jamming.

A sheet-handling device disclosed in JP-A-09-235069 includes first and second introduction passages for guiding the sheet discharged from an image-forming machine into a sheet conveyer passage prior to introducing the sheet to an intermediate stacker, change-over means for changing over the inlet of either the first introduction passage or the second introduction passage, and a pair of conveyer rollers for conveying, into the intermediate stacker, the two pieces of sheets conveyed from the first and second introduction passages in a state of being overlapped one upon the other with their ends being abut. What is aimed at by this device is to efficiently convey the sheet to improve the productivity without delaying or interrupting the formation of image by the image-forming machine and the continuous discharge of the paper between the preceding handling of the sheaf of sheets and the subsequent handing-over of the sheaf of sheets. However, this device must be provided with two introduction passages and change-over means in addition to the sheet conveyer passage causing the constitution to become complex and making it difficult to cope with the jamming. Besides, only two pieces of sheets are permitted to stand by.

SUMMARY OF THE INVENTION

An object of the present invention is to provide a novel sheet-handling device for improving the production efficiency by making it possible to convey a plurality of sheets in an overlapped manner through a sheet conveyer passage and to continuously handle the sheets without discontinuing the image-forming operation of the image-forming machine.

Another object of the present invention is to provide a novel sheet-handling device for improving the production efficiency by making it possible to convey three or more pieces of sheets in an overlapped manner through a sheet conveyer passage and to continuously handle the sheets without discontinuing the image-forming operation of the image-forming machine.

A further object of the present invention is to provide a novel sheet-handling device which makes it possible to convey a plurality of pieces of sheets in an overlapped manner through a sheet conveyer passage, to simplify the constitution and to facilitate the handling of the jamming.

According to one aspect of the present invention, there is provided a sheet-handling device comprising an intermediate tray, an intermediate conveyer passage for guiding a sheet into the intermediate tray, introduction rollers for introducing the sheet into the intermediate conveyer passage, conveying rollers for conveying, into the intermediate tray, the sheet introduced into the intermediate conveyer passage, a holder member for releasably holding the sheet introduced into the intermediate conveyer passage in a manner of being faced to the conveyer surface of the intermediate conveyer passage, holder member drive means for driving the holder member, introduction roller drive means for so driving the introduction rollers as to rotate forward, conveying roller drive means for so driving the conveying rollers as to rotate forward or reverse, and a controller for controlling the drive means;

wherein, when a standby/overlap handling mode is set to select the number of pieces of sheets that are to stand by and are to overlap in the intermediate conveyer passage to be a predetermined number N (=2 pieces) to form a next sheaf of sheets following the preceding sheaf of sheets conveyed into the intermediate tray, the controller so controls the drive means that:

the introduction rollers and the conveying rollers are rotated forward so that a first sheet introduced into the intermediate conveyer passage is nipped at its leading end by the conveying rollers and is conveyed until the trailing end thereof separates away from the introduction rollers and, thereafter, the conveying rollers are halted; and a second sheet is introduced into the intermediate conveyer passage by the introduction rollers in a state where the first sheet is held by the holder member, and the conveying rollers are rotated forward when the leading end of the second sheet has approached a nipping portion of the conveying rollers, so that the leading end of the second sheet is nipped being overlapped on the first sheet that has been nipped already by the conveying rollers, and the sheets of the predetermined number N (=2 pieces) are conveyed in an overlapped manner into the intermediate tray.

It is desired that the holder member can be displaced by holder member drive means to a holding position where the sheet introduced into the intermediate conveyer passage is held being faced to the conveyer surface and to a release position where the holding is released.

It is desired that the holding member includes a pair of support shafts which extend in the direction of width of the sheet at right angles with a direction in which the sheet is introduced and are so supported as to rotate on the same axis maintaining a distance in the direction of the width, a pair of arms extending in parallel from the support shafts, and a holder portion extending across the arms in parallel with the axis, wherein the distance between the arms in the direction of the width is set to be greater than the size of the sheet in the direction of width, the holder portion is separated from the conveyer surface up to a position where the leading end of the sheet that is introduced does not interfere therewith in a state where the holder member is displaced to the release position, the holder portion is brought to a position where the leading end of the sheet that is introduced does not interfere therewith in a state where the holder member is displaced to the holding position, and the arms are so positioned that the sheet that is introduced is allowed to be conveyed toward the conveying rollers passing through between the arms without interfering therewith.

It is desired that the holder portion holds the trailing end of the sheet in a state where the holder member is displaced to the holding position.

It is desired that the distance between the nipping portion of the introduction rollers and the nipping portion of the conveying rollers is set to be shorter than the length in the direction of conveyance of a sheet of a predetermined size introduced into the intermediate conveyer passage.

It is desired that a movable guide member is arranged in the intermediate conveyer passage at a position just downstream of the introduction rollers so as to be displaced by an actuator to a first position for guiding a sheet of the predetermined size that is introduced toward the conveying rollers and to a second position for guiding a sheet of a particular size greater than the predetermined size that is introduced toward the intermediate tray, the movable guide member constituting a portion of the conveyer surface of the intermediate conveyer passage.

According to another aspect of the present invention, there is provided a sheet-handling device comprising an intermediate tray, an intermediate conveyer passage for guiding a sheet into the intermediate tray, introduction rollers for introducing the sheet into the intermediate conveyer passage, conveying rollers for conveying, into the intermediate tray, the sheet introduced into the intermediate conveyer passage, a holder member for releasably holding the sheet introduced into the intermediate conveyer passage in a manner of being faced to the conveyer surface of the intermediate conveyer passage, holder member drive means for driving the holder member, introduction roller drive means for so driving the introduction rollers as to rotate forward, conveying roller drive means for so driving the conveying rollers as to rotate forward or reverse, and a controller for controlling the drive means;

wherein, when a standby/overlap handling mode is set to select the number of pieces of sheets that are to stand by and are to overlap in the intermediate conveyer passage to be a predetermined number N which is equal to or more than three pieces to form a next sheaf of sheets following the preceding sheaf of sheets introduced into the intermediate tray, the controller so controls the drive means that:

the introduction rollers and the conveying rollers are rotated forward so that a first sheet introduced into the intermediate conveyer passage is nipped at its leading end by the conveying rollers and is conveyed until the trailing end thereof separates away from the introduction rollers and, thereafter, the conveying rollers are halted;

the conveying rollers are rotated forward for a second or subsequent sheet, except the N-th sheet, successively introduced by the introduction rollers into the intermediate conveyer passage when the leading end thereof has approached the nipping portion of the conveying rollers, so that the leading end is nipped by the conveying rollers and, after having conveyed the sheet until the trailing end separates away from the introduction rollers and passes through the holder portion of the holder member, the conveying rollers are halted, the holding by the holder member is released, the conveying rollers are rotated reverse, and the sheet is moved back while being held again by the holder member and is halted in a state where the leading end is nipped; and finally, an N-th sheet is introduced by the introduction rollers into the intermediate conveyer passage in a state where the (N−1)-th sheet is held by the holder member, and the conveying rollers are rotated forward when the leading end of the N-th sheet has approached a nipping portion of the conveying rollers, so that the leading end of the N-th sheet is nipped being overlapped on the (N−1)-th sheet that has been nipped already by the conveying rollers, and the sheets of the predetermined number N are conveyed in an overlapped manner into the intermediate tray.

It is desired that the holder member can be displaced by holder member drive means to a holding position where the sheet introduced into the intermediate conveyer passage is held being faced to the conveyer surface and to a release position where the holding is released.

It is desired that the holding member includes a pair of support shafts which extend in the direction of width of the sheet at right angles with a direction in which the sheet is introduced and are so supported as to rotate on the same axis maintaining a distance in the direction of the width, a pair of arms extending in parallel from the support shafts, and a holder portion extending across the arms in parallel with the axis, wherein the distance between the arms in the direction of the width is set to be greater than the size of the sheet in the direction of width, the holder portion is separated from the conveyer surface up to a position where the leading end of the sheet that is introduced does not interfere therewith in a state where the holder member is displaced to the release position, the holder portion is brought to a position where the leading end of the sheet that is introduced does not interfere therewith in a state where the holder member is displaced to the holding position, and the arms are so positioned that the sheet that is introduced is allowed to be conveyed toward the conveying rollers passing through between the arms without interfering therewith.

It is desired that the holder portion holds the trailing end of the sheet in a state where the holder member is displaced to the holding position.

It is desired that the distance between the nipping portion of the introduction rollers and the nipping portion of the conveying rollers is set to be shorter than the length in the direction of conveyance of a sheet of a predetermined size introduced into the intermediate conveyer passage.

It is desired that a movable guide member is arranged in the intermediate conveyer passage at a position just downstream of the introduction rollers so as to be displaced by an actuator to a first position for guiding a sheet of the predetermined size that is introduced toward the conveying rollers and to a second position for guiding a sheet of a particular size greater than the predetermined size that is introduced toward the intermediate tray, the movable guide member constituting a portion of the convey surface of the intermediate conveyer passage.

DETAILED DESCRIPTION OF THE PREFERRED EMBODIMENTS

Embodiments of the sheet-handling device constituted according to the present invention will now be described in detail with reference to the accompanying drawings.

Figure 1:
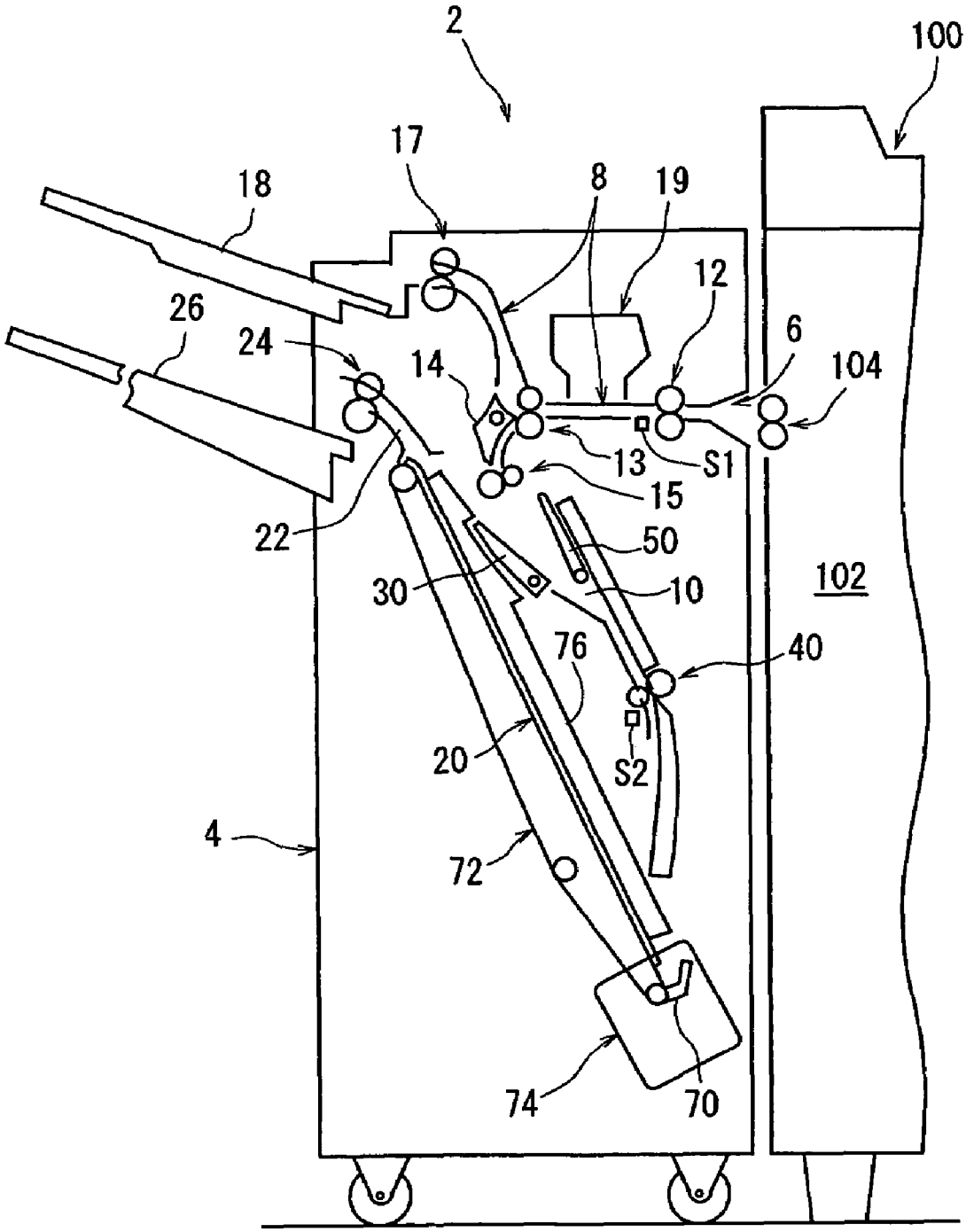
FIG. 1 is a schematic view of constitution illustrating an embodiment of a sheet-handling device according to the present invention.
Figure 2:
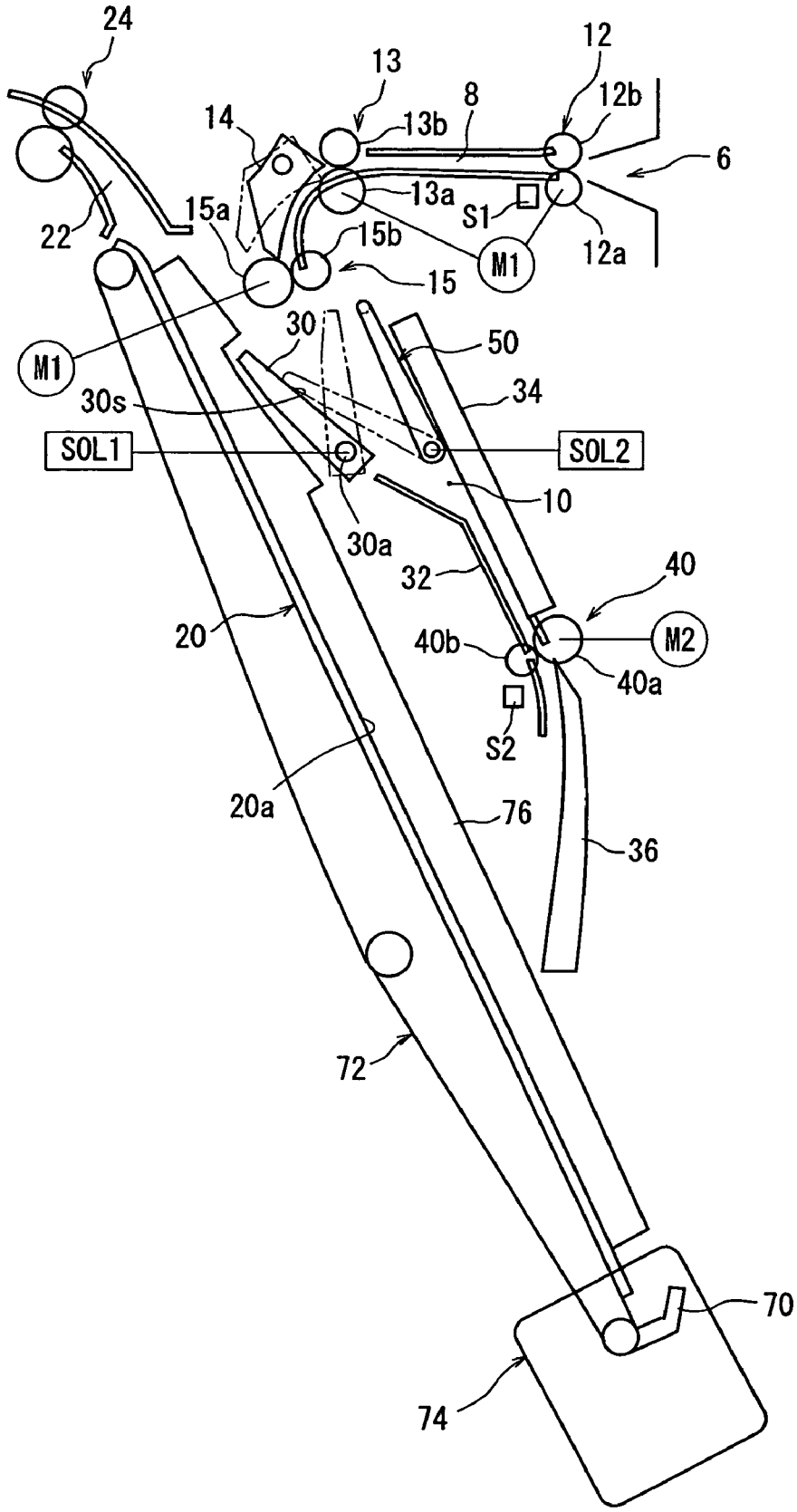
FIG. 2 is a schematic view of constitution illustrating, on an enlarged scale, major portions of the sheet-handling device shown in FIG. 1.

Referring to FIGS. 1 and 2, reference numeral 100 denotes an electrostatic copier which is an image-forming machine. The copier 100 is provided with a copier body 102 which is the body of the image-forming machine of a rectangular parallelepiped shape (only a portion thereof is shown in FIG. 1).

A sheet discharge port is formed in a side portion of the copier body 102, and a pair of sheet discharge rollers 104 are arranged at a position just upstream of the sheet discharge port. The copier 100 itself utilizes a known constitution which does not constitute a feature of the present invention and is not described here. A sheet-handling device 2 according to an embodiment of the invention is attached neighboring the above one side portion of the copier body 102.

The sheet-handling device 2 is provided with a housing 4 of a rectangular parallelepiped shape. A sheet conveying port 6 is provided in a side portion of the housing 4 opposing the side portion of the copier body 102 at a position opposed to the sheet discharge port. The sheet conveying port 6 is constituted by a pair of guide plates arranged facing each other maintaining a distance in the up-and-down direction and being opened up and down facing the sheet discharge port of the copier body 102. A sheet conveyer passage 8 is arranged in the housing 4 extending from the sheet conveying port 6 toward the other side portion of the housing 4. In the housing 4, there is further arranged an intermediate conveyer passage 10 branching from the sheet conveyer passage 8 and extending toward an intermediate tray 20 that will be described later.

Inlet conveyer rollers 12 are arranged in the sheet conveyer passage 8 at a position just downstream of the sheet conveying port 6. Intermediate conveyer rollers 13 and a branching pawl 14 are arranged at a branching portion between the sheet conveyer passage 8 and the intermediate conveyer passage 10. Introduction rollers 15 are arranged in the intermediate conveyer passage 10 near the branching portion to introduce the sheet into the intermediate conveyer passage 10. Discharge rollers 17 are arranged at a downstream end of the sheet conveyer passage 8. A sub-tray 18 is mounted on the other side portion of the housing 4, which is the discharge side, so as to receive and hold the sheets discharged from the discharge rollers 17.

The branching pawl 14 is so constituted as can be moved by a solenoid that is not shown to a first position represented by a two-dot chain line in FIG. 2 and to a second position represented by a solid line in FIG. 2. When the solenoid is turned off, the branching pawl 14 is brought to the first position, and the sheet conveyed through the sheet conveying port 6 is conveyed toward the discharge rollers 17 by the inlet conveyer rollers 12 and the intermediate conveyer rollers 13 passing through the sheet conveyer passage 8. When the solenoid is turned on, the branching pawl 14 is brought to the second position, and the sheet conveyed through the sheet conveying port 6 is conveyed by the inlet conveyer rollers 12, intermediate conveyer rollers 13 and introduction rollers 15 into the intermediate conveyer passage 10 from the branching portion of the sheet conveyer passage 8. A punch unit 19 is arranged in the sheet conveyer passage 8 between the inlet conveyer rollers 12 and the intermediate conveyer rollers 13. A first sheet sensor S1 for detecting the sheet that is conveyed is disposed in the sheet conveyer passage 8 at a position just downstream of the sheet conveying inlet 6.

An intermediate tray 20 is arranged in the housing 4 extending and being tilted in the up-and-down direction. The surface 20*a* of the intermediate tray 20 is tilted in the up-and-down direction and is extending substantially linearly. A discharge passage 22 is arranged on an extension of the intermediate tray 20 from the lower side toward the upper side, and discharge rollers 24 are arranged at a downstream end of the discharge passage 22. A main tray 26 is arranged on the other side which is the discharge side of the housing 4, so as to receive and hold the sheets discharged from the discharge rollers 24.

The intermediate conveyer passage 10 for guiding the sheet to the intermediate tray 20 is curved downward from the branching portion, and is extending from the upper side toward the lower side of the intermediate tray 20 maintaining a distance relative to the surface 20*a* of the intermediate tray 20. The introduction rollers 15 are arranged at the downstream end of the curved portion of the intermediate conveyer passage 10. In this embodiment, the intermediate conveyer passage 10 includes a movable guide member 30 arranged in the intermediate conveyer passage 10 at a position just downstream of the introduction rollers 15 and is extending from the upper side toward the lower side of the intermediate tray 20, a stationary guide member 32 arranged on the downstream of the movable guide member 30, a first opposing stationary guide member 34 arranged from near the upstream end of the movable guide member 30 up to near the downstream end of the stationary guide member 32 being opposed to the movable guide member 30 and the stationary guide member 32 maintaining a distance relative thereto, and a second opposing stationary guide member 36 arranged being opposed to the downstream end of the stationary guide member 32 maintaining a distance and extending downward while being mildly curved toward a position close to the lower end of the surface 20*a* of the intermediate tray 20. Conveying rollers 40 are arranged at a boundary portion between the first opposing stationary guide member 34 and the second opposing stationary guide member 36 in the intermediate conveyer passage 10 thereby to convey the sheet introduced into the intermediate conveyer passage 10 to the intermediate tray 20. A second sheet sensor S2 is arranged in the intermediate conveyer passage 10 at a position just downstream of the conveying rollers 40 to detect the sheet that moves toward the surface 20*a* of the intermediate tray 20.

Figure 3:
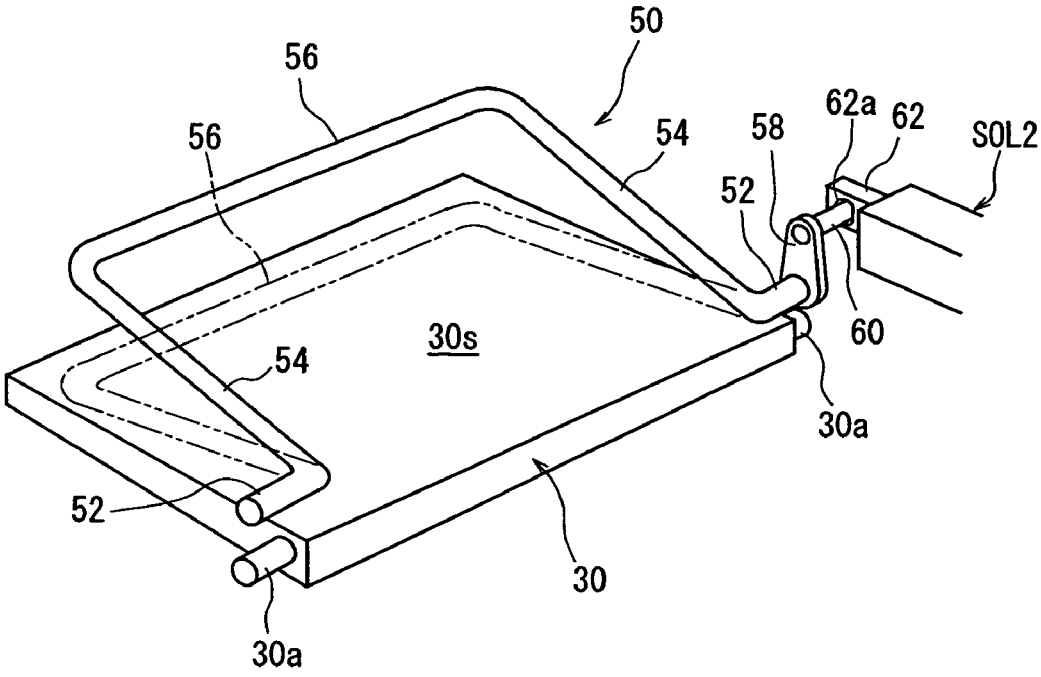
FIG. 3 is a schematic perspective view illustrating a holder member and an upstream end of an intermediate conveyer passage shown in FIG. 2.

The first opposing stationary guide member 34 is extending nearly in parallel with the surface 20*a* of the intermediate tray 20. Referring to FIGS. 1 to 3, the movable guide member 30 arranged between the first opposing stationary guide member 34 and the surface 20*a* of the intermediate tray 20, is supported by a frame that is not shown so as to rotate about a shaft 30*a* that extends in a direction of width of the sheet (in a direction perpendicular to the surface of the paper in FIG. 2), which is at right angles with the direction in which the sheet is conveyed (direction of introduction). The shaft 30*a* of the movable guide member 30 is arranged at a downstream end of the movable guide member 30. The movable guide member 30 can be displaced by an actuator such as a solenoid SOL1 to a first position (represented by a solid line in FIG. 2) where the sheet of a predetermined size introduced by the introduction rollers 15 is guided toward the conveying rollers 40, and to a second position (represented by a two-dot chain line in FIG. 2) where the sheet of a particular size greater than the predetermined size introduced by the introduction rollers 15 is directly guided toward the surface 20*a* of the intermediate tray 20. It is desired that the solenoid SOL1 is constituted by a self-maintaining solenoid which is substantially the same as a solenoid SOL2 that will be described later.

The sheet of the predetermined size in this embodiment has the width A4 under the JIS (direction of conveyance is in agreement with the direction of the width which is short), and the sheet of the particular size greater than the predetermined size in this embodiment has the height A3 under the JIS (direction of conveyance is in agreement with the direction of the height which is long). The distance between the nipping portion of the introduction rollers 15 and the nipping portion of the conveying rollers 40 is set to be shorter than the length in the direction of conveyance of the sheet of the predetermined size (width A4) introduced into the intermediate conveyer passage 10.

The movable guide member 30 is positioned maintaining a distance relative to nearly the upper end of the surface 20*a* of the intermediate tray 20. In a state of being brought to the first position, the movable guide member 30 is positioned being so tilted as to gradually separate away from the surface 20*a* of the intermediate tray 20 as it goes from the upstream end thereof toward the downstream end thereof. In a state of being brought to the second position, on the other hand, the movable guide member 30 is positioned being so tilted as to gradually approach the surface 20*a* of the intermediate tray 20 as it goes from the upstream end thereof toward the downstream end thereof. The conveyer surface 30*s* of the movable guide member 30 constitutes a portion of the conveyer surface of the intermediate conveyer passage 10. In the state where the movable guide member 30 is brought to the first position, the upstream end region of the stationary guide member 32 is so tilted as to extend, along the extension of the movable guide member 30, toward the first opposing stationary guide member 34, and the region downstream of the upstream end region extends toward the downstream nearly in parallel with the first opposing stationary guide member 34 up to the upstream end region of the second opposing stationary guide member 36.

A holder member 50 is arranged in the intermediate conveyer passage 10 at a position just downstream of the introduction rollers 15 and is facing the movable guide member 30. The holder member 50 is capable of releasably holding the sheet that is introduced into the intermediate conveyer passage 10 from the introduction rollers 15 so as to be faced to the conveyer surface on the upstream side of the intermediate conveyer passage 10 or, in this embodiment, so as to be faced to the conveyer surface 30*s* of the movable guide member 30 brought to the first position.

Referring to FIGS. 2 and 3, the holding member 50 includes a pair of support shafts 52 which extend in the direction of width of the sheet at right angles with the direction in which the sheet is introduced and are so supported as to rotate on the same axis maintaining a distance in the direction of the width, a pair of arms 54 extending in parallel from the support shafts 52, and a holder portion 56 extending across the arms 54 in parallel with the axis. The support shafts 52 are supported by the frame via bearings (not shown). A lever 58 extending in a radial direction is fixed to one support shaft 52. A pin 60 is fixed to an end of the lever 58, the pin 60 having an axis in parallel with the support shafts 52. An end of the pin 60 is fitted to an elongated hole 62*a* formed at an end of a moving core 62 of the solenoid SOL2 which is the actuator.

It is desired that the solenoid SOL2 constituting the holder member drive means is of the self-maintaining type. When the solenoid SOL2 is turned on to protrude the moving core 62, the holder member 50 is turned in one direction about the support shafts 52, and the holder portion 56 is displaced from the release position that will be described later to the holding position (represented by a two-dot chain line in FIGS. 2 and 3) where the sheet introduced into the intermediate conveyer passage 10 is held so as to be faced to the conveyer surface 30*s* of the movable guide member 30. When the solenoid SOL2 is turned off to return the moving core 62 back to the initial position, the holder portion 56 is turned reverse about the support shafts 52, and is displaced from the holding position to the release position (represented by a solid line in FIGS. 2 and 3) where the holding is released. When the self-maintaining solenoid is turned on or off, the flow of electric current discontinues after the electric current is supplied first. Therefore, the ON operation stands for an exciting operation for protruding the moving core 62 by a predetermined amount from a position shown in FIG. 3, and the OFF operation stands for an exciting operation for returning back to the position shown in FIG. 3 from the position protruded by the predetermined amount. The holder member drive means may be an electric motor.

The distance between the arms 54 of the holder member 50 in the direction of the width is set to be greater than the predetermined size (width A4) of the sheet in the direction of width. This constitution permits a next sheet to be introduced into the intermediate conveyer passage 10 in a state where the sheet is held by the holder member 50. In a state where the holder member 50 is displaced to the release position, the holder portion 56 is separated away from the conveyer surface 30*s* of the movable guide member 30 up to a position where the leading end of the sheet that is introduced does not interfere therewith. In a state where the holder member 50 is displaced to the holding position, the holder portion 56 is so positioned as to come into slight contact with the conveyer surface 30*s* or maintains a distance relative thereto. The distance is set to be greater than the thickness of the stack of the sheets of a predetermined maximum number N of pieces that are introduced. In either constitution, the sheet is allowed to smoothly move in the direction of conveyance between the conveyer surface 30*s* and the holder portion 56 in the state where the holder member 50 is displaced to the holding position. Even when the holder portion 56 is so positioned as to come in slight contact with the conveyer surface 30*s*, the sheet is not prevented from smoothly moving if the holder member 50 is made of a synthetic resin having a relatively small coefficient of friction. In the state where the holder member 50 is displaced to the holding position, the holder portion 56 is brought to a position where the leading end of the sheet that is introduced does not interfere therewith. The arms 54 are so positioned that the sheet that is introduced is conveyed toward the conveying rollers 40 passing through between the arms without interfering therewith.

Referring to FIGS. 1 and 2, the inlet conveyer rollers 12, intermediate conveyer rollers 13 and introduction rollers 15 are each constituted by drive rollers 12*a*, 13*a*, 15*a* and driven rollers 12*b*, 13*b*, 15*b*. The drive rollers 12*a*, 13*a* and 15*a* are driven by a conveyer motor M1 which is a common electric motor. In the introduction rollers 15, the conveyer motor M1 constitutes introduction roller drive means which may include an electromagnetic clutch that is not shown. The conveying rollers 40 are constituted by a drive roller 40*a* and a driven roller 40*b*. The drive roller 40*a* is rotated by a conveying motor M2 which is an electric motor that can be rotated forward and reverse. The conveying motor M2 constitutes conveying roller drive means. The conveying motor M2 may be a stepping motor.

The sheet-handling device 2 further includes a receiving member 70 for receiving the leading end of the sheet that is conveyed into the intermediate tray 20 and for stocking it, sheet-moving means 72 for moving the sheaf of sheets received and stocked by the receiving member 70 toward the discharge rollers 24, i.e., toward the main tray 26, a stapler 74 which is sheet-handling means for handling the sheaf of sheets conveyed into the intermediate tray 20, and matching means which is not shown including a pair of width control plates 76 (only one width control plate 76 is shown in FIGS. 1 and 2) positioned in the intermediate tray 20 maintaining a distance in the direction of width. These constitutions may be the known ones and are not described here.

Figure 4:
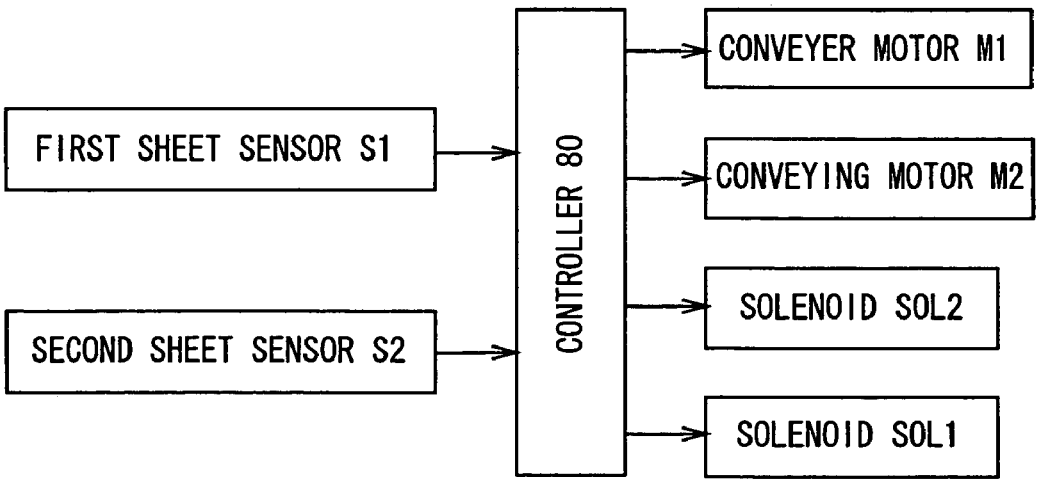
FIG. 4 is a block diagram illustrating a portion of a control system in the sheet-handling device shown in FIG. 1.

Referring to FIGS. 2 and 4, the sheet-handling device 2 further includes a controller 80. The controller 80 is constituted by a microcomputer and includes a central processing unit (CPU) which executes arithmetic processings according to control programs, a ROM for storing the control programs, a read-write RAM for storing the results of operations, a timer, a counter, an input interface and an output interface. The thus constituted controller 80 receives, through the input interface thereof, the detection signals from the first sheet sensor S1, second sheet sensor S2 and other switches or detectors, and produces, through the output interface thereof, the control signals to the conveyer motor M1, conveying motor M2, other electric motors that are not shown, solenoid SOL1, solenoid SOL2, electric motors in the matching means, electromagnetic clutches that are not shown, and a solenoid that is not shown for the branching pawl 14. Further, the controller 80 in the sheet-handling device 2 is connected to the controller that is not shown in the copier body 102, and control signals are exchanged therebetween.

The controller in the copier body 102 receives copying data from a copy start key, a key for setting the sheet size (length in the direction of conveyance), a key for setting the stapling, a key for setting the number of copies to be stapled, a key for sorting (non-staple handling) other than the stapling, such as for simply specifying the sorting, and a key for setting the number of copies to be sorted, which are arranged on the operation means but are not shown here.

The sheet-handling device 2 in the copier 100 according to the embodiment is constituted as described above. Described below is the operation of a portion to which the invention is concerned in the case when the stapling mode is set by specifying the stapling by using the staple-setting key. It needs not be pointed out that the following control operation is executed by the controller 80.

Figure 5:
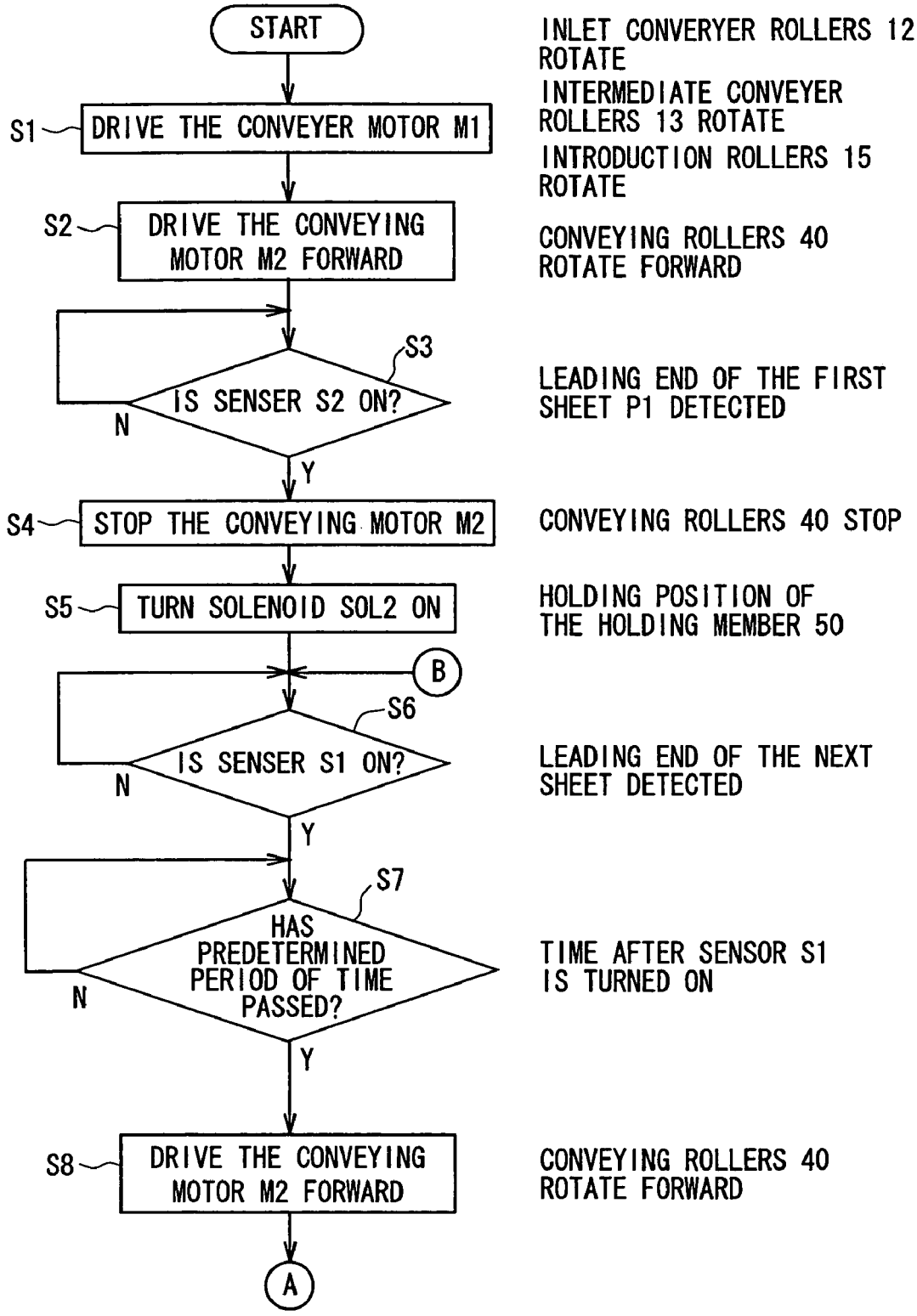
FIG. 5 is a flowchart illustrating a portion of an operation procedure in the major portions of the sheet-handling device shown in FIG. 2.
Figure 6:
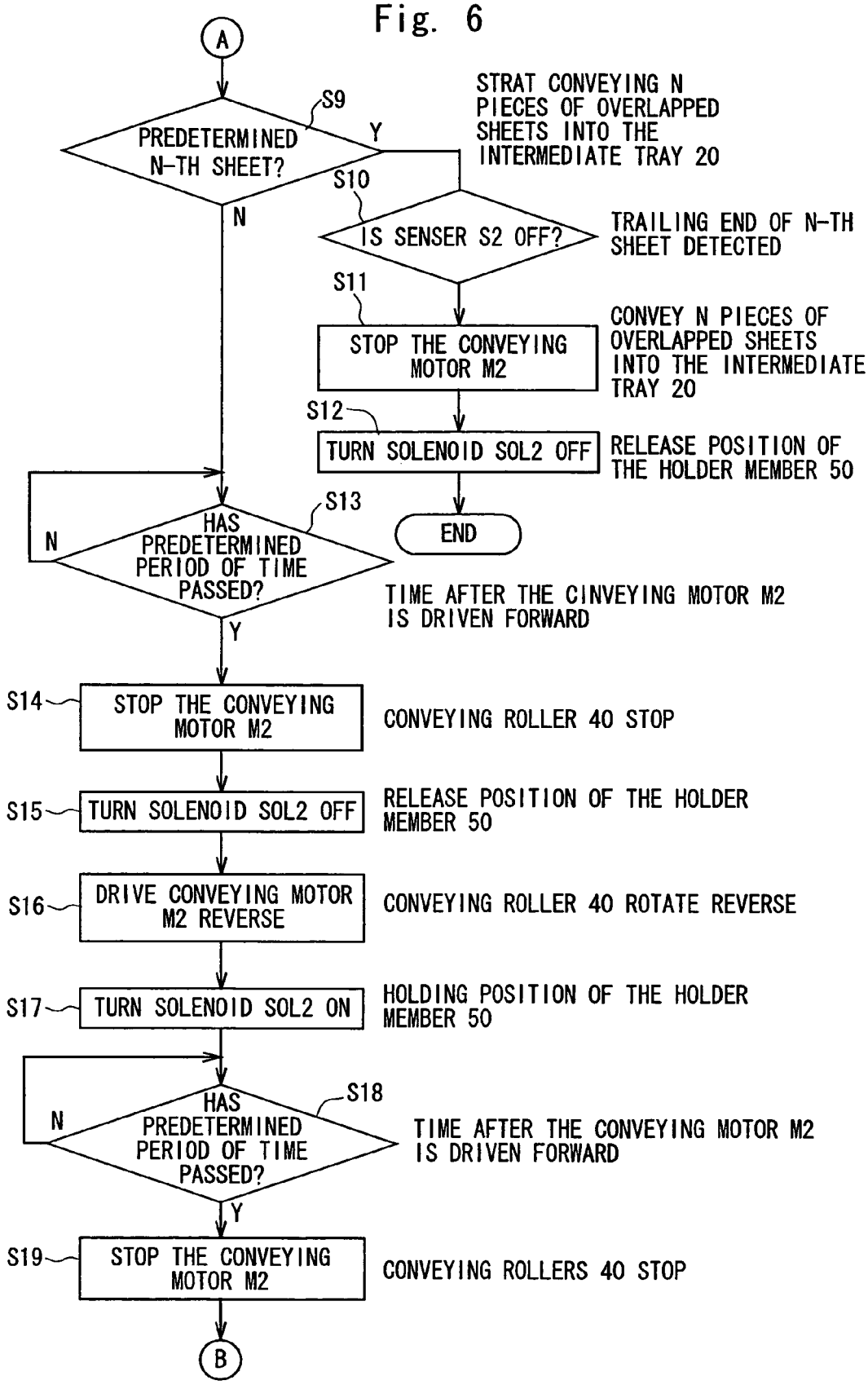
FIG. 6 is a flowchart continuing from the flowchart of FIG. 5.
Figure 7:
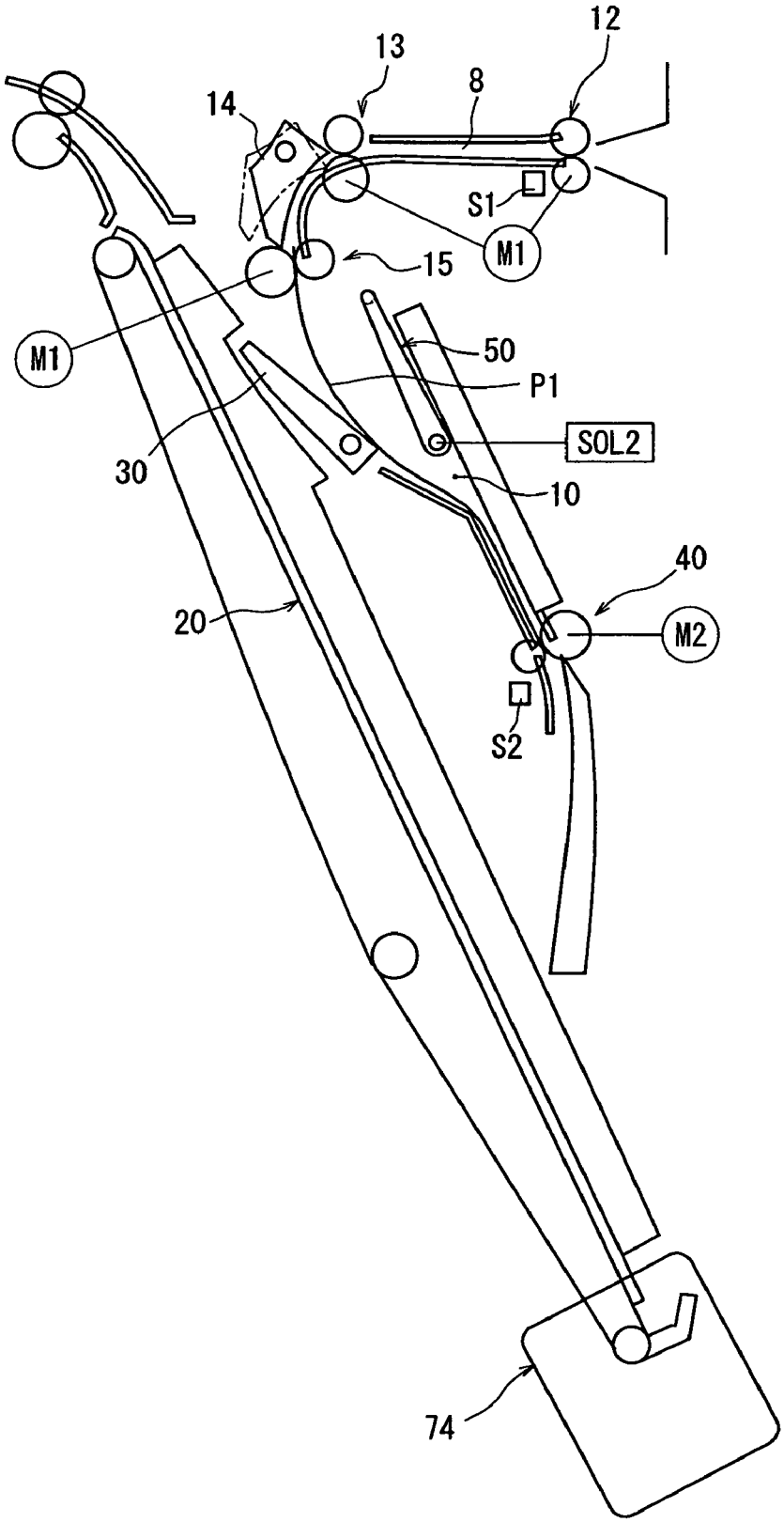
FIG. 7 is a schematic view of constitution illustrating a state of operation in the major portions of the sheet-handling device shown in FIG. 2.
Figure 8:
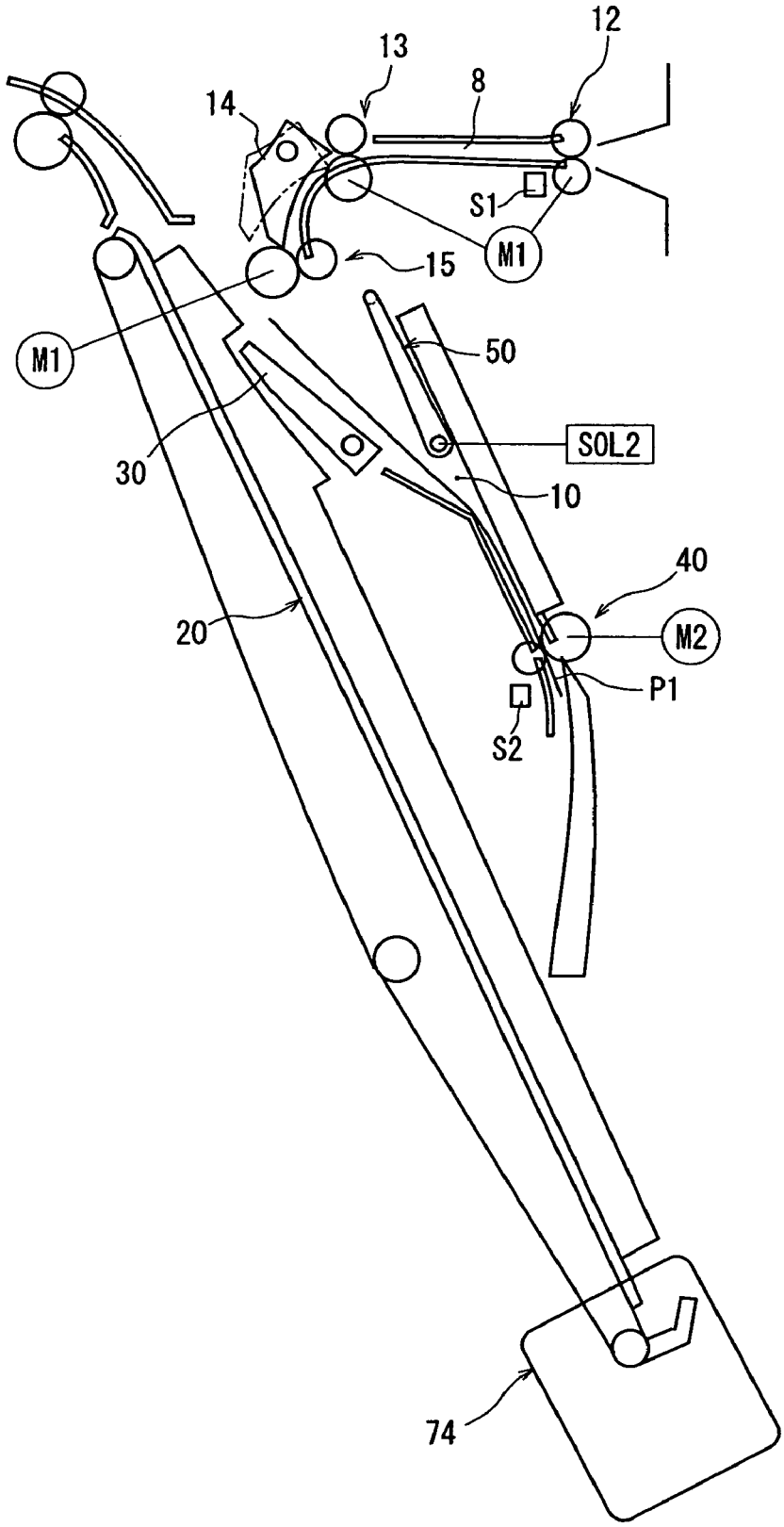
FIG. 8 is a schematic view of constitution illustrating another state of operation in the major portions of the sheet-handling device shown in FIG. 2.

Referring to FIGS. 2, 5 and 6 (flowcharts), the branching pawl 14 is brought to the second position represented by the solid line in FIG. 2, and the movable guide plate 30 is brought to the first position represented by the solid line in FIG. 2. Further, the holder member 50 is brought to the release position represented by the solid line in FIG. 2. First, the conveyer motor M1 is driven to rotate the inlet conveyer rollers 12, intermediate conveyer rollers 13 and introduction rollers 15 (step S1). Next, the conveying motor M2 is driven forward to rotate the conveying rollers 40 forward (step S2). A first sheet P1 (see FIG. 7 and subsequent drawings) conveyed from the copier body 102 is conveyed through the branching portion of the sheet conveyer passage 8 into the intermediate conveyer passage 10 due to the inlet conveyer rollers 12, intermediate conveyer rollers 13 and introduction rollers 15. FIG. 7 illustrates a state where the leading end of the sheet P1 in the direction of conveyance is nipped by the conveyer rollers 40, and the trailing end is nipped by the introduction rollers 15 while the sheet P1 is being conveyed by these rollers. Referring to FIG. 8, when the leading end of the sheet P1 is detected by the second sheet sensor S2 (step S3), the trailing end of the sheet P1 is released from being nipped by the introduction rollers 15, the conveying motor M2 is no longer driven to rotate forward (step S4), and the sheet P1 is no longer conveyed.

Figure 9:
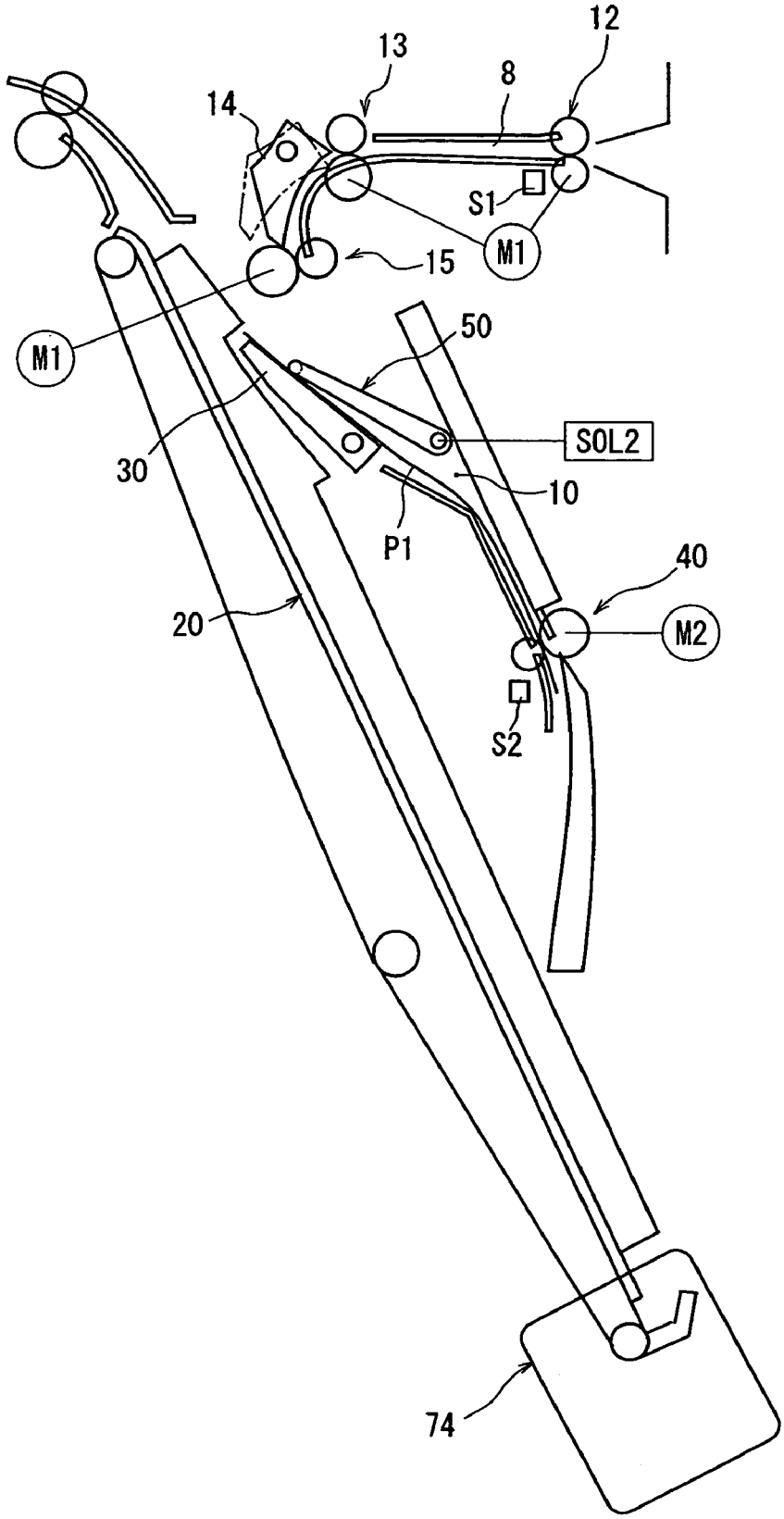
FIG. 9 is a schematic view of constitution illustrating a further state of operation in the major portions of the sheet-handling device shown in FIG. 2.

Here, the solenoid SOL2 is turned on (step S5) and the holder member 50 is displaced from the release position shown in FIG. 8 to the holding position shown in FIG. 9. The trailing end of the sheet P1 is held by the holding portion 56 of the holding member 50 in a manner of being faced to the conveyer surface 30*s* of the movable guide member 30. The leading end of the sheet P1 is held in a state of being nipped by the nipping portion of the conveying rollers 40. The sheet P1 is in a standby state in the intermediate conveyer passage 10.

Figure 10:
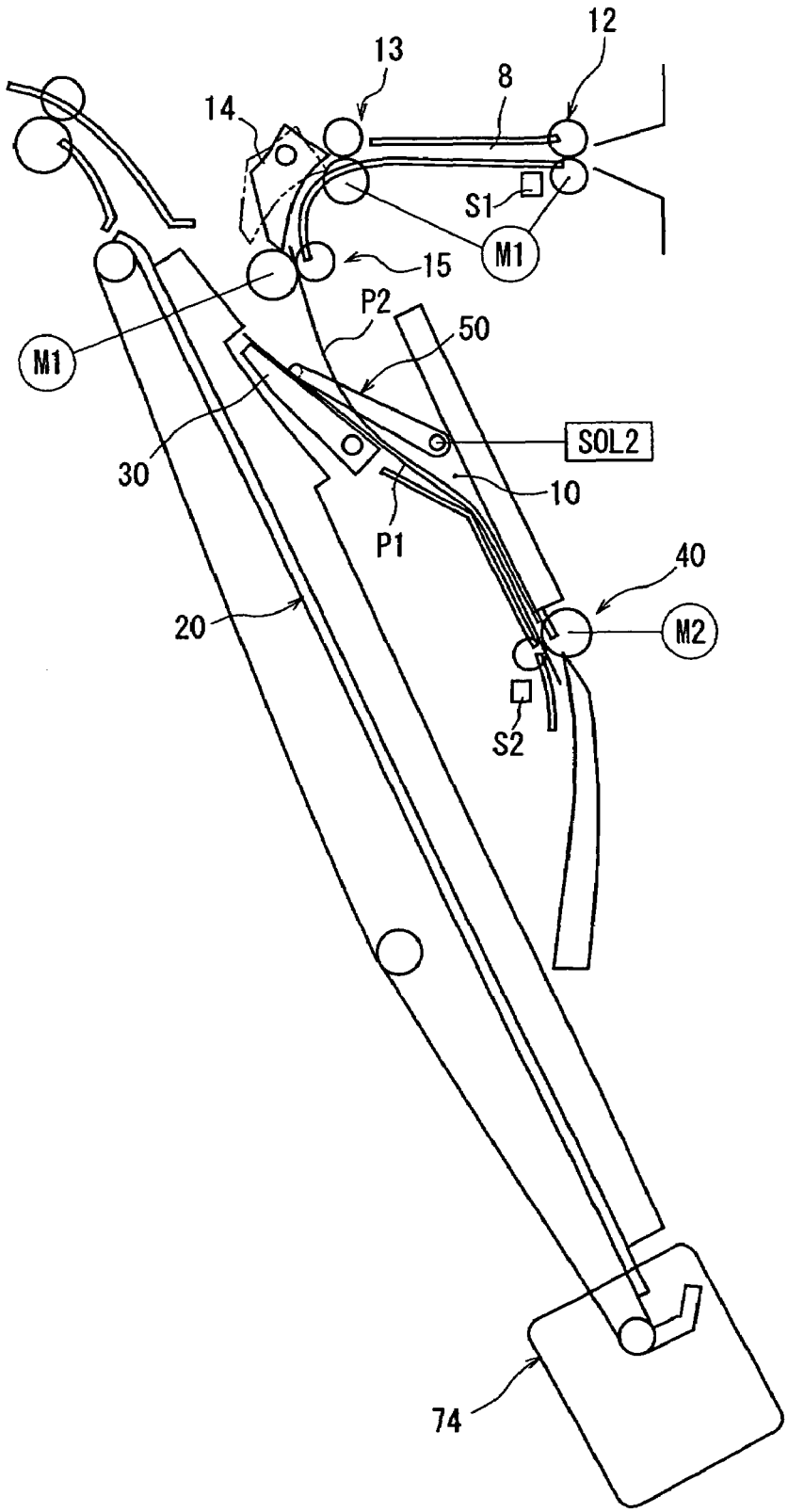
FIG. 10 is a schematic view of constitution illustrating a still further state of operation in the major portions of the sheet-handling device shown in FIG. 2.

After the passage of a predetermined period of time from when the second sheet P2 is conveyed from the copier body 102, the conveying motor M2 is rotated forward (step S6 to step S8). The predetermined period of time is set to be a time from when the leading end of the second sheet P2 has passed the first sheet sensor S1 until when it approaches the nipping portion of the conveying rollers 40 or, in this embodiment, is set as a time until the leading end of the second sheet P2 reaches just before the nipping portion of the conveying rollers 40. FIG. 10 illustrates a state where the leading end of the second sheet P2 has reached just before the nipping portion of the conveying rollers 40 after having passed through the first sheet sensor S1. The conveying rollers 40 are rotated forward, the leading end of the second sheet P2 is nipped by the nipping portion of the conveying rollers 40 being overlapped on the leading end of the first sheet P1, and the second sheet P2 is conveyed together with the first sheet P1.

Here, the controller 80 executes different control operations depending upon when the standby/overlap handling mode is set to select the number of pieces of sheets that are to stand by and are to overlap in the intermediate conveyer passage 10 to be a predetermined number (N=two pieces) to form a next sheaf of sheets following the preceding sheaf of sheets conveyed into the intermediate tray 20 and when the standby/overlap handling mode is set to select the number of pieces of sheets that are to stand by and are to overlap in the intermediate conveyer passage 10 to be a predetermined number N which is equal to or more than three pieces to form a next sheaf of sheets following the preceding sheaf of sheets conveyed into the intermediate tray 20. The above modes of treatment have been set in advance in the control program of the controller 80. This is because, the number of pieces of sheets that are to stand by and are to be overlapped in the intermediate conveyer passage 10 is determined by a relationship between the rate of conveying the sheets by the device and the rate of handling the sheets in the intermediate tray 20. Therefore, the number of pieces of sheets that are to stand by and are to be overlapped increases with an increase in the ratio of the rate for conveying the sheets relative to the rate of handling the sheets.

Figure 11:
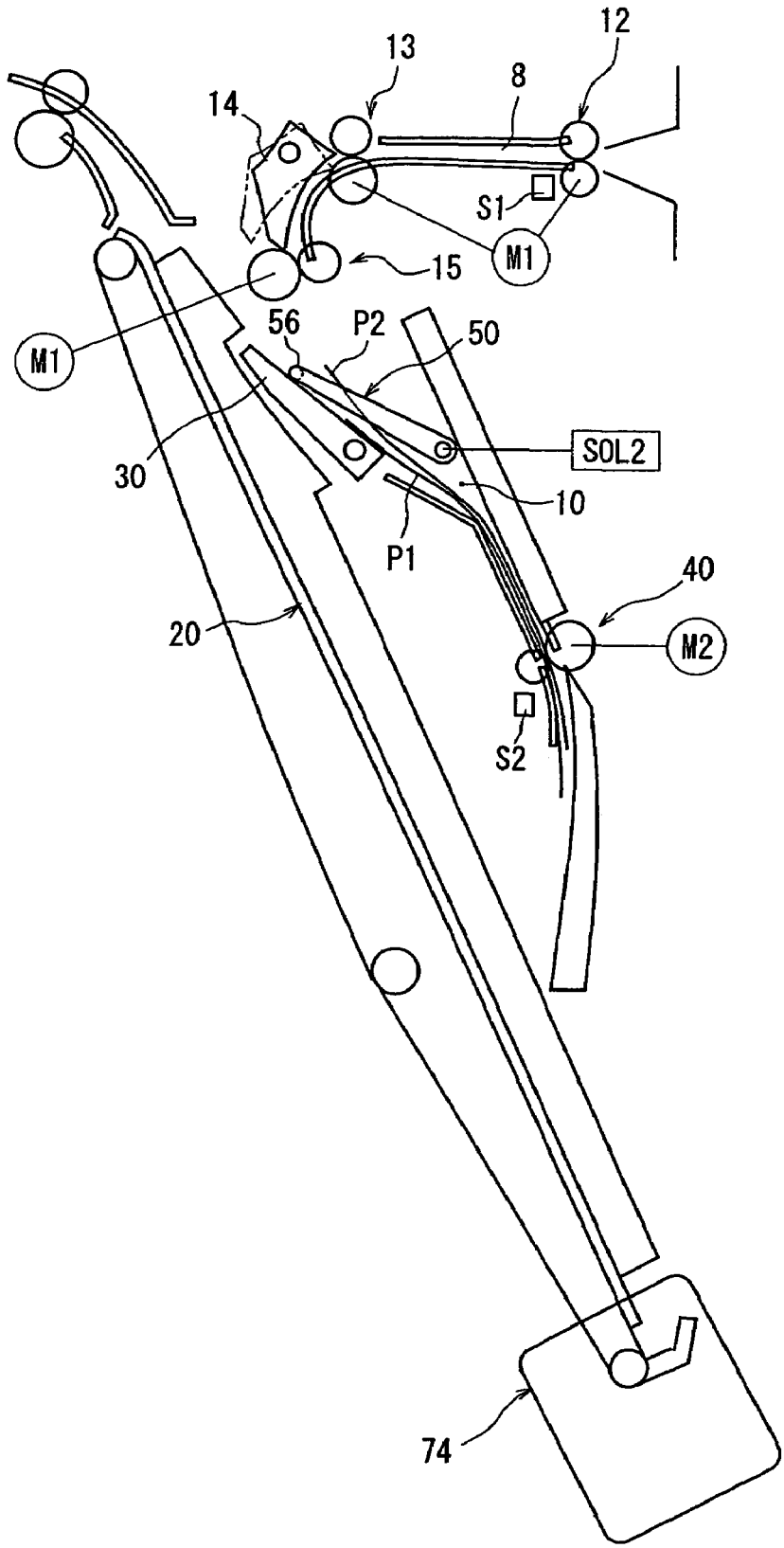
FIG. 11 is a schematic view of constitution illustrating a yet further state of operation in the major portions of the sheet-handling device shown in FIG. 2.
Figure 12:
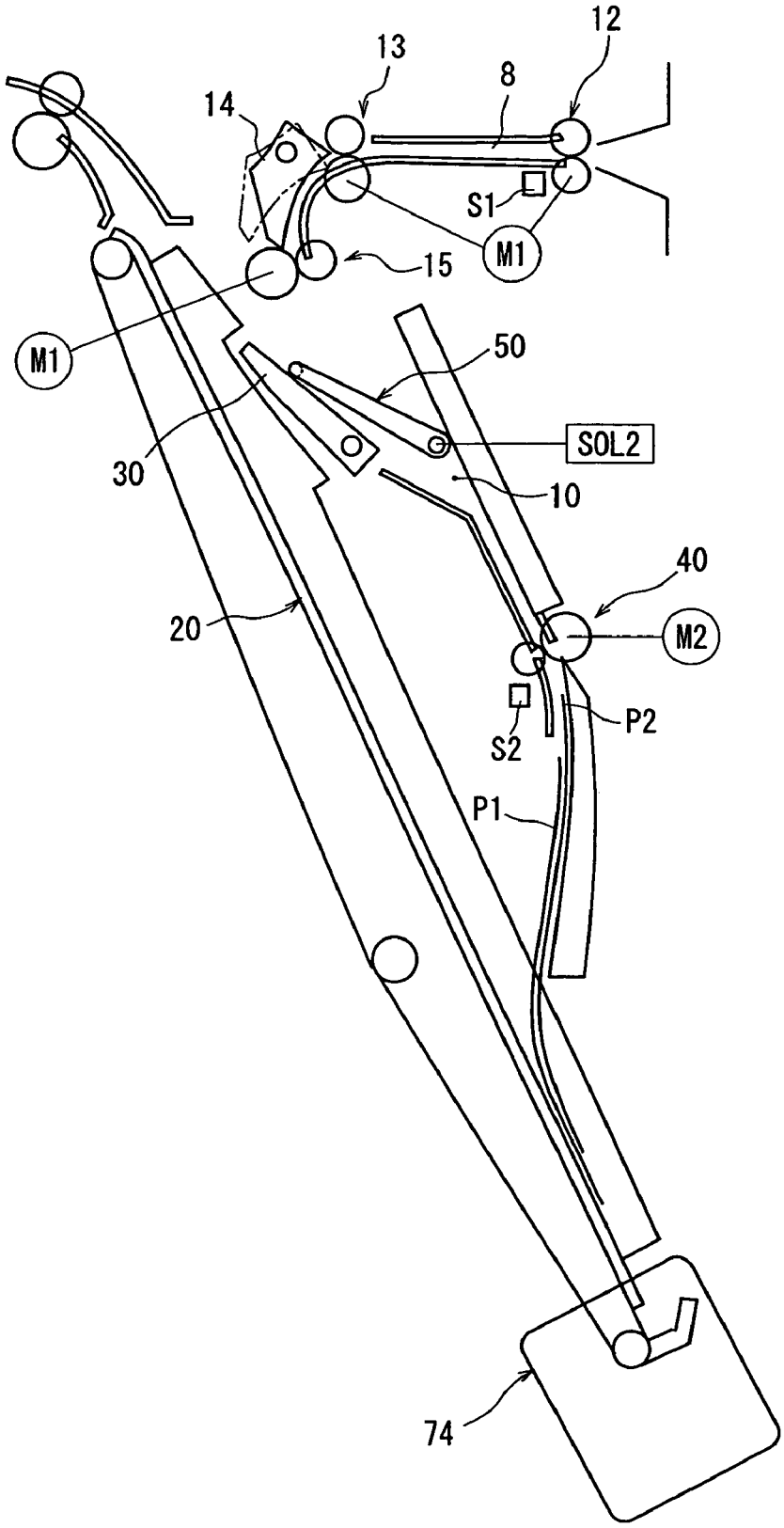
FIG. 12 is a schematic view of constitution illustrating a still another state of operation in the major portions of the sheet-handling device shown in FIG. 2.
Figure 13:
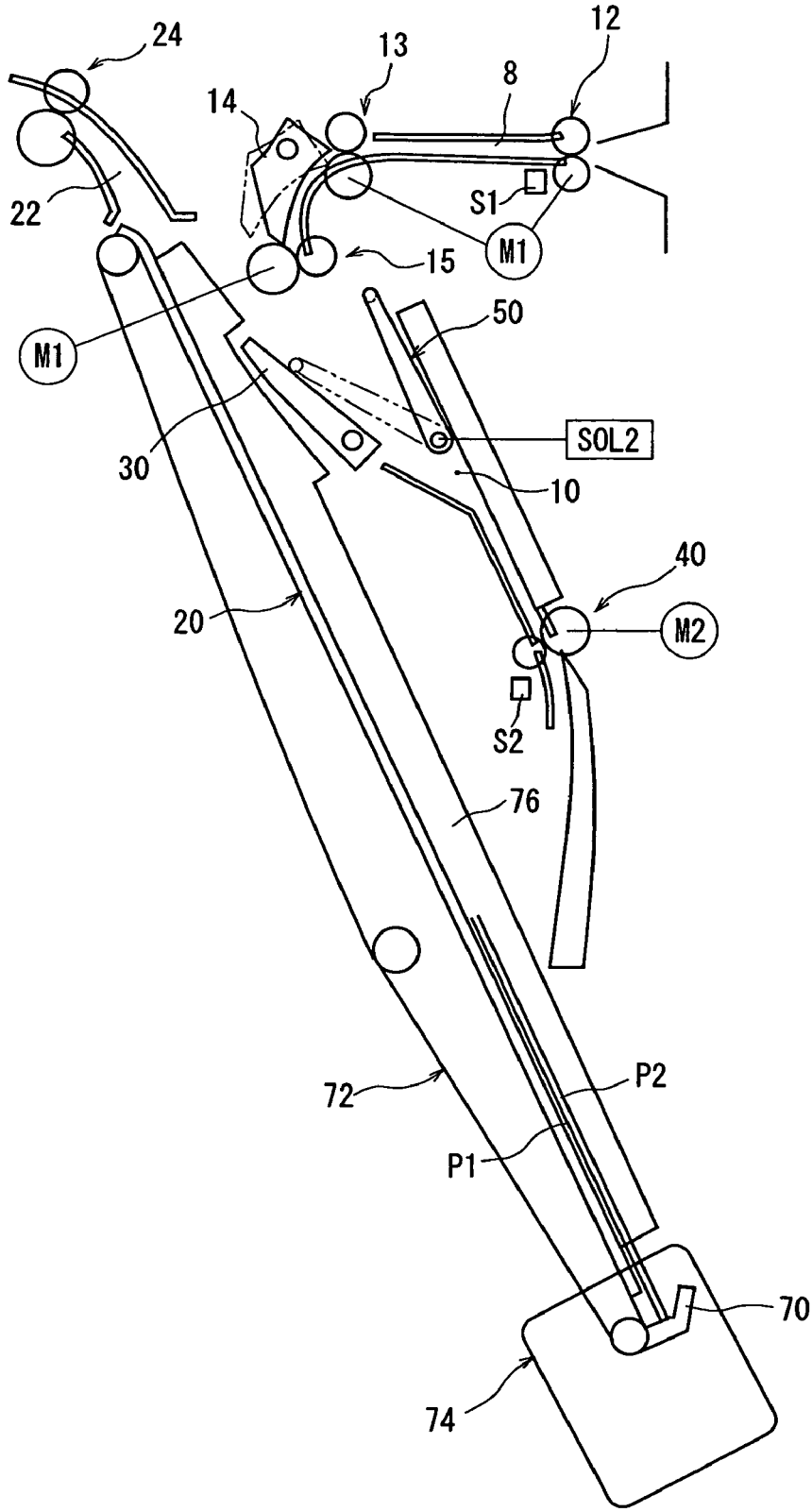
FIG. 13 is a schematic view of constitution illustrating a further state of operation in the major portions of the sheet-handling device shown in FIG. 2.

When there is set the standby/overlap handling mode to select the number of pieces of sheets that are to stand by and are to overlap in the intermediate conveyer passage 10 to be a predetermined number (N=two pieces) to form a next sheaf of sheets following the preceding sheaf of sheets conveyed into the intermediate tray 20, it is judged at step S9 that the predetermined number is N=2 pieces. The conveying rollers 40 are rotating forward and, hence, the second sheet P2 and the first sheet P1 are conveyed in an overlapped manner toward the intermediate tray 20. FIG. 11 illustrates the state of the above conveyance. Here, the sheaf of sheets (not shown) conveyed earlier into the intermediate tray 20 has been stapled by the stapler 74 and has been discharged onto the main tray 26. Therefore, the intermediate tray 20 is ready to receive the next sheaf of sheets. When the trailing end of the second sheet P2 passes through the second sheet sensor S2 (see FIG. 12), the conveying motor M2 is no longer driven (step S10 to step S11). The second sheet P2 and the first sheet P1 are conveyed in an overlapped manner into the intermediate tray 20, and are stacked as their leading ends are received by the receiving member 70 (see FIG. 13). Further, the solenoid SOL2 is turned off (step S12), and the holder member 50 is displaced from the holding position represented by the two-dot chain line to the release position represented by the solid line in FIG. 13. As described above, the control operation is finished until when two pieces of sheets P1 and P2 introduced into the intermediate conveyer passage 10 are conveyed in an overlapped manner into the intermediate tray 20. When the number of pieces of a sheaf to be stapled is, for example, three pieces, the third sheet does not stand by in the intermediate conveyer passage 10 but is conveyed straight into the intermediate tray 20, and a sheaf of three pieces of sheets is formed in the intermediate tray 20. The above processing is repeated until the number of copies to be stapled reaches a predetermined number.

Figure 14:
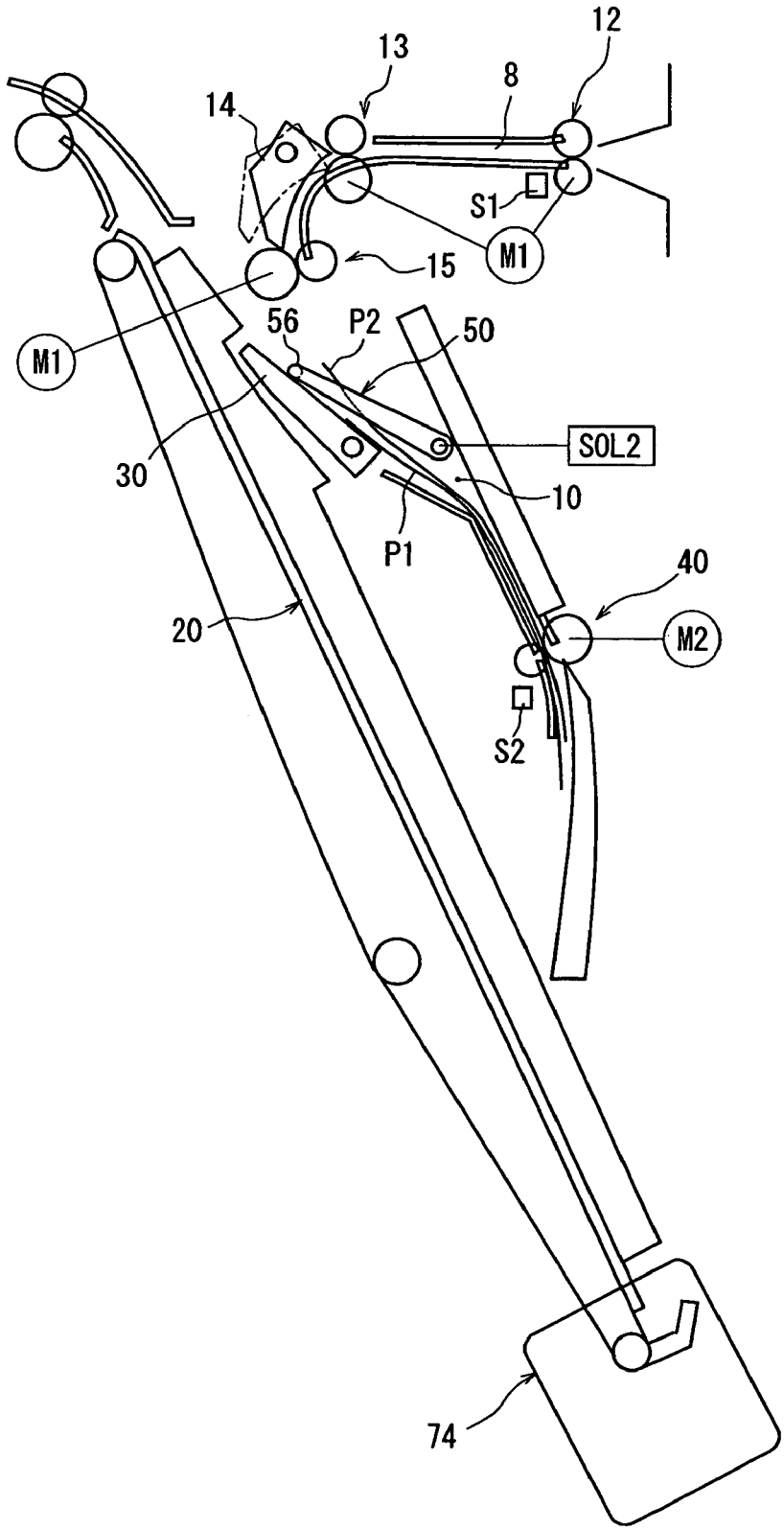
FIG. 14 is a schematic view of constitution illustrating a still further state of operation in the major portions of the sheet-handling device shown in FIG. 2.

On the other hand, when there is set the standby/overlap handling mode to select the number of pieces of sheets that are to stand by and are to overlap in the intermediate conveyer passage 10 to be a predetermined number N which is equal to or more than three pieces to form a next sheaf of sheets following the preceding sheaf of sheets conveyed into the intermediate tray 20, it is judged at step S9 that the predetermined number is N pieces. The conveying motor M2 stops rotating after the passage of a predetermined period of time from when it was driven to rotate forward (step S13 to step S14). The predetermined period of time is set to be a time from when the trailing end of the second sheet P2 is separated from the introduction rollers 15 until when it passes through the holder portion 56 of the holder member 50. FIG. 14 illustrates a state where the conveying roller 40 is brought into a halt immediately after the trailing end of the second sheet P2 has passed through the holder portion 56 of the holder member 50. The leading end and the trailing end of the second sheet P2 are positioned slightly on the downstream of the leading end and the trailing end of the first sheet P1.

Figure 15:
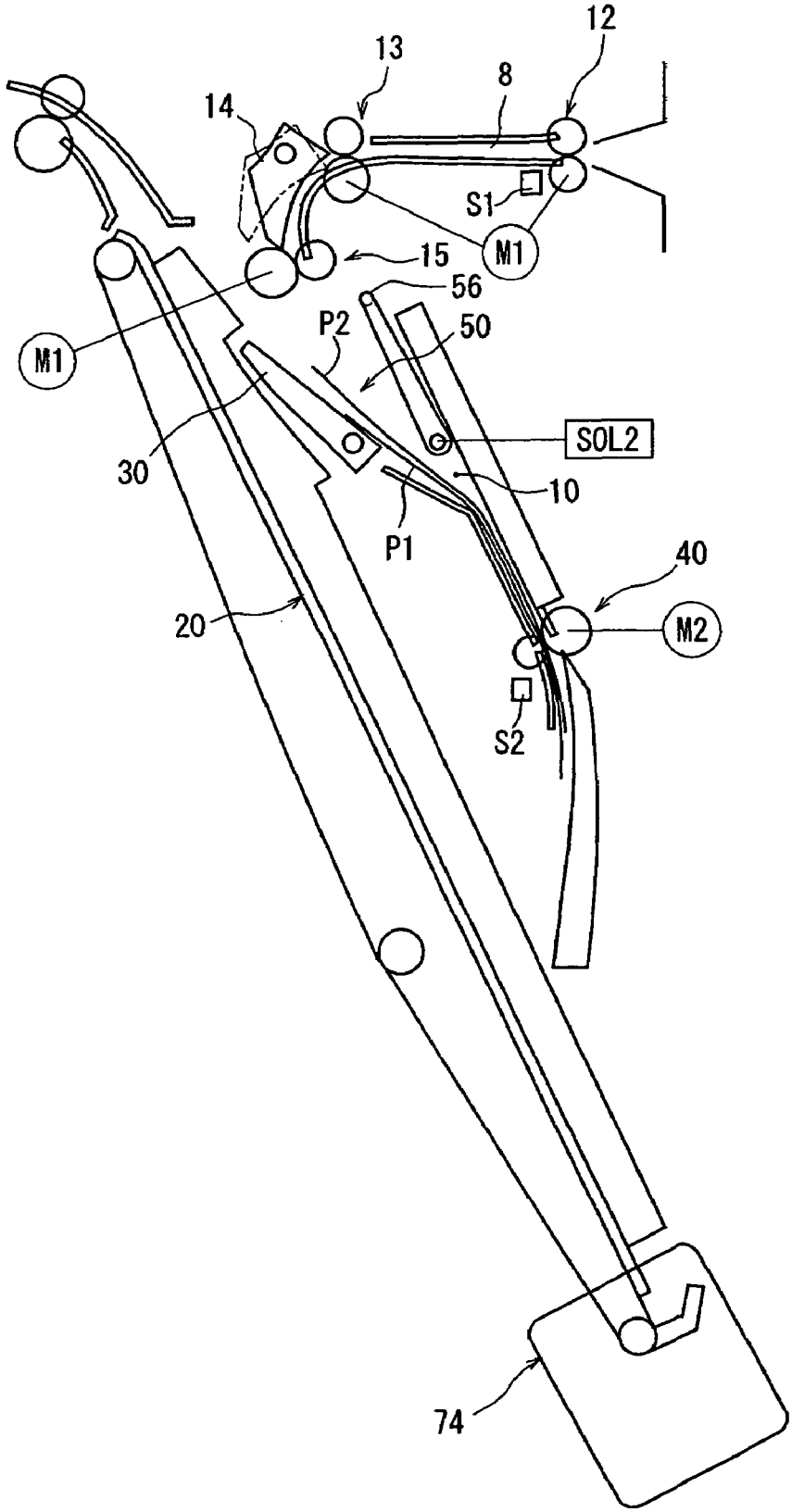
FIG. 15 is a schematic view of constitution illustrating a further state of operation in the major portions of the sheet-handling device shown in FIG. 2.
Figure 16:
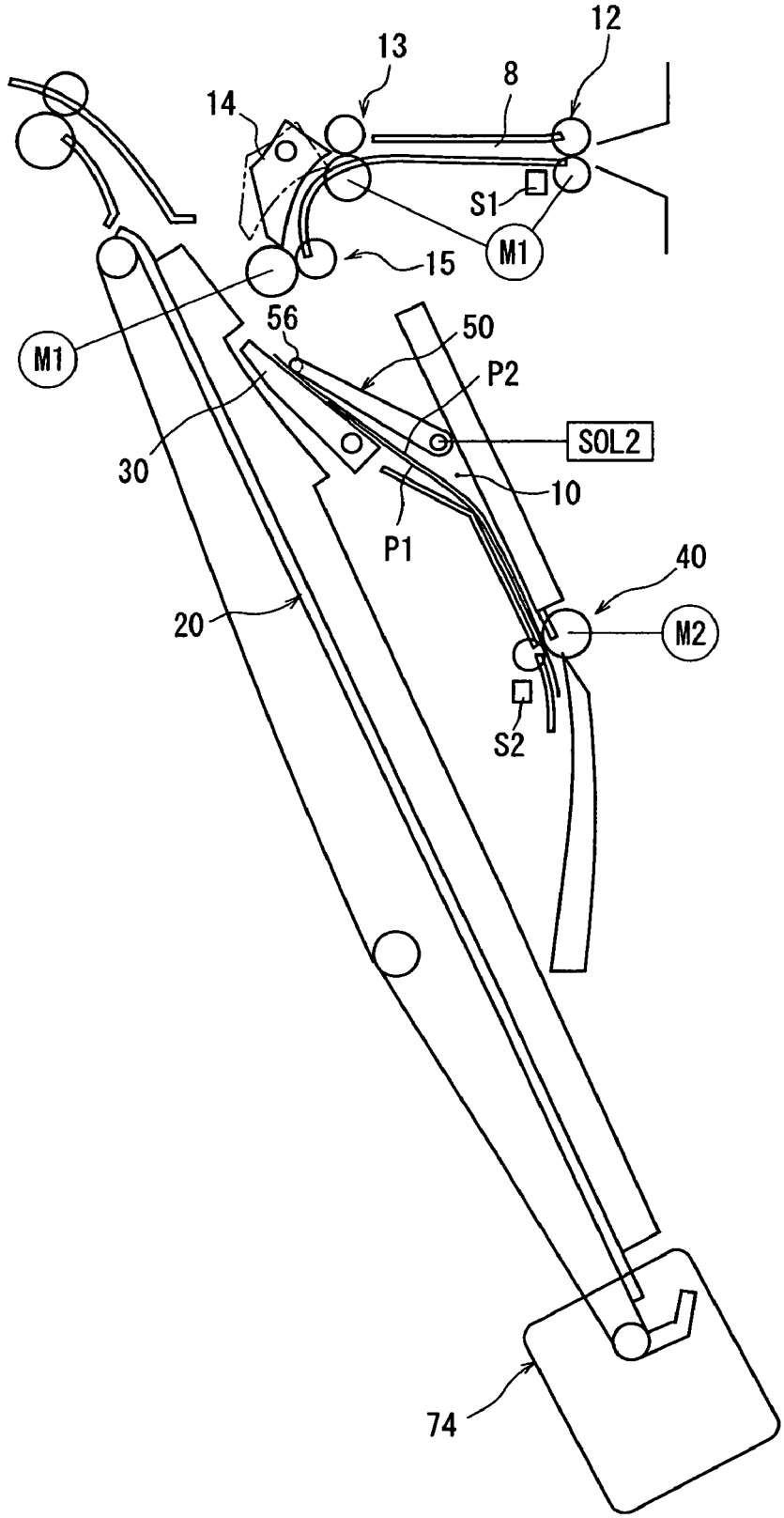
FIG. 16 is a schematic view of constitution illustrating a another state of operation in the major portions of the sheet-handling device shown in FIG. 2.

Next, the solenoid SOL2 is turned off, and the holder member 50 is displaced from the holding position to the release position (step S15). FIG. 15 illustrates this state. Thereafter, the conveying motor M2 is driven reverse and the conveying rollers 40 rotate reverse (step S16). The second sheet P2 and the first sheet P1 retreat in an overlapped manner. Next, the solenoid SOL2 is turned on, and the holder member 50 is displaced from the release position to the holding position (step S17). The sheets P2 and P1 retreat with their trailing ends being held by the holder portion 56 of the holder member 50. After the passage of a predetermined period of time from when the conveying motor M2 is driven to rotate reverse, the conveying motor M2 is no longer driven (step S18 to step S19). The predetermined period of time is set to be a time in which the leading end of the sheet P2 positioned slightly downstream of the leading end of the sheet P1 is not out of the nipping portion of the conveying rollers 40. The conveying rollers 40 come into a halt in a state of nipping the leading ends of the sheet P2 and of the sheet P1. FIG. 16 illustrates this state.

Next, the controller 80 effects again, at step S6 to step S9, the control operation for the third and subsequent sheets that are introduced and judges at step S9 whether the third or subsequent sheet is the predetermined N-th sheet. When it is judged at step S9 that the third or subsequent sheet is the predetermined N-th sheet, the control operation is executed from step S10 to step S12 to finish the control operation. On the other hand, when it is judged at step S9 that the third or the subsequent sheet is not the predetermined N-th sheet, the control operation is executed from step S13 to step S19. The routine, then, returns to step S6 to repeat the control operation from step S6 to step S9. The control operation is repeated until it is judged that the third or the subsequent sheet is the predetermined N-th sheet. The controller 80 controls the conveyer motor M1, conveying motor M2 and the solenoid SOL2 so that the sheets of a predetermined number N (N which is equal to or more than three pieces) are conveyed into the intermediate tray 20 in a manner as described above. For example, when the predetermined number is N=3 pieces and the number of pieces of a sheaf to be stapled is five pieces, the fourth and fifth sheets do not stand by in the intermediate conveyer passage 10 but are conveyed straight into the intermediate tray 20, such that a sheaf of five pieces is formed in the intermediate tray 20. The above processing is repeated until the number of copies to be stapled reaches a predetermined number.

The present invention makes it possible to convey a plurality of sheets (not only two pieces of sheets but also three or more pieces of sheets) in a manner to stand by and to overlap in the intermediate conveyer passage 10 which is a sheet conveyer passage until a sheaf of sheets conveyed into the intermediate tray 20 is handled and discharged in order to form a next sheaf of sheets following a sheaf of sheets conveyed into the intermediate tray 20. During this period, further, the invention continuously handles the sheets without discontinuing the image-forming operation of the copier 100. Therefore, the present invention improves the production efficiency. The invention achieves the above-mentioned effect by simply providing the intermediate conveyer passage 10 in a number of one instead of providing a plurality of sheet conveyer passages and, besides, without providing a branching pawl for the intermediate conveyer passage 10 downstream of the introduction rollers 15, simplifying the constitution and saving space. Besides, the jamming can be easily handled.

The sheets P1 and P2 conveyed into the intermediate tray 20, and received and stocked by the receiving member 70, are adjusted for their positions in the direction of width by matching means which includes a pair of width control plates 76, and are stapled by the stapler 74. The sheets P1 and P2 that are stapled are conveyed by sheet-moving means 72 toward the discharge rollers 24 through the discharge passage 22, and are discharged onto the main tray 26 by the discharge rollers 24.

Figure 17:
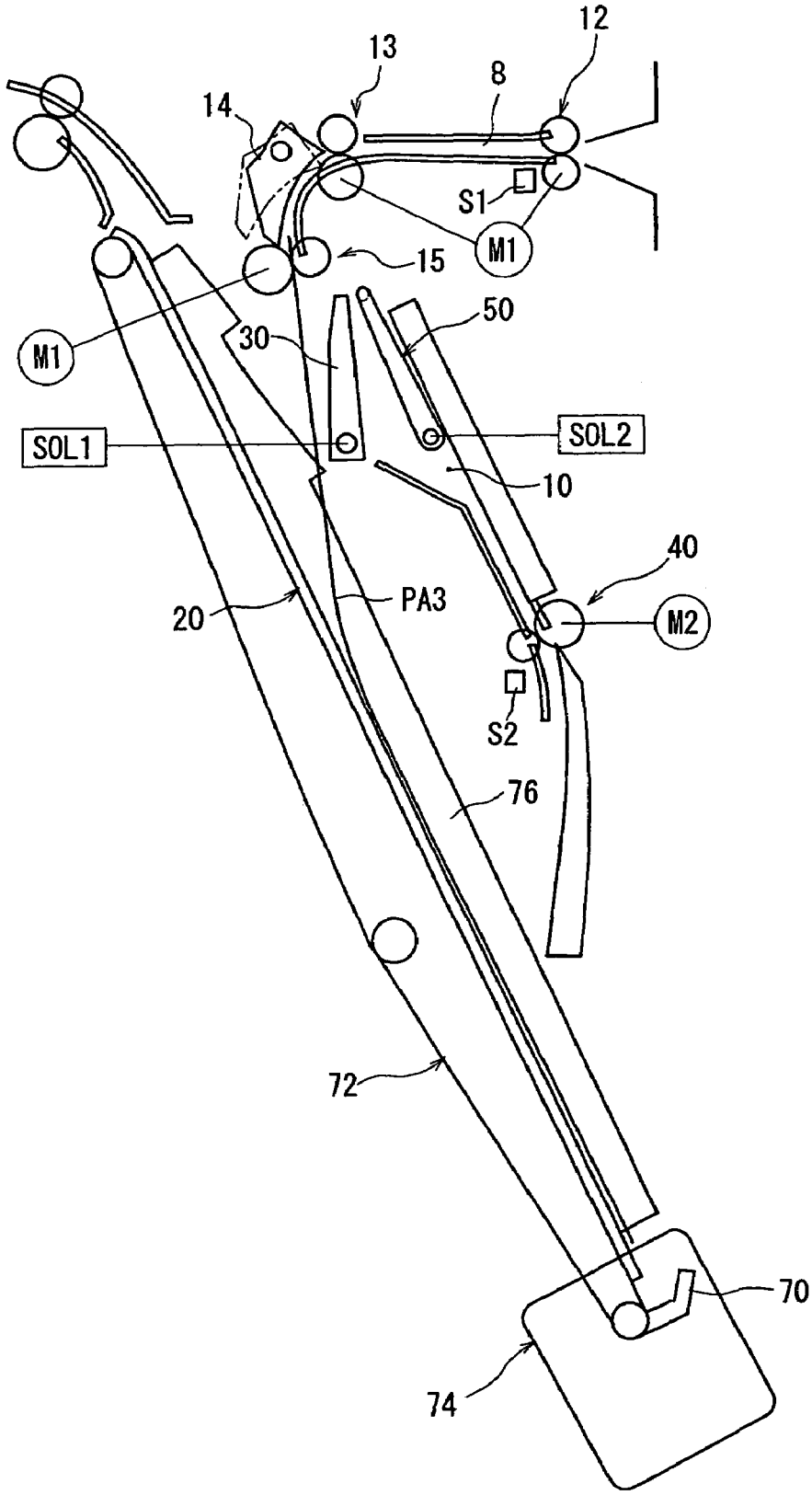
FIG. 17 is a schematic view of constitution illustrating a further state of operation in the major portions of the sheet-handling device shown in FIG. 2.

As described earlier, the sheet introduced into the intermediate conveyer passage 10 and conveyed into the intermediate tray 20 is the one having a predetermined relatively small size or, in this embodiment, having an A4-size, and is conveyed in a direction in which it has a small length. On the other hand, the sheet having a particular size greater than the above predetermined size, i.e., in this embodiment, the sheet having an A3-size, is conveyed from the upstream end of the intermediate conveyer passage 10 directly into the intermediate tray 20 in a direction in which it has a large length. That is, referring to FIG. 17, when the stapling is specified for the sheet of the A3-size, the solenoid SOLL is turned on and the movable guide member 30 is displaced from the first position to the second position (represented by a solid line in FIG. 17). The sheet PA3 of the A3-size is introduced by the introduction rollers 15 onto the upstream end of the intermediate conveyer passage 10, and is conveyed into the intermediate tray 20 from the upstream region thereof being guided by the movable guide member 30. FIG. 17 illustrates this state. The leading end of the sheet PA3 conveyed into the intermediate tray 20 is received by the receiving member 70. A plurality of sheets PA3 conveyed into the intermediate tray 20, received and stocked by the receiving member 70, are stapled by the stapler 74, conveyed by sheet-moving means 72 toward the sub-discharge rollers 24 through the sub-discharge passage 22, and are discharged onto the main tray 26 from the sub-discharge roller 24.

According to the present invention as described above, the movable guide member 30 is arranged in the intermediate conveyer passage 10 at a position just downstream of the introduction rollers 15 so as to be displaced by the solenoid SOLL to the first position for guiding the sheet of the predetermined size that is introduced toward the conveying rollers 40 and to the second position for guiding the sheet of the particular size greater than the predetermined size that is introduced toward the intermediate tray 20. That is, upon simply providing the single intermediate conveyer passage 10, a plurality of sheets of different sizes (sheets of at least two kinds of different sizes) can be handled by being conveyed into the intermediate tray 10 in a manner of being overlapped one upon the other, which is practicable and useful.

In the above-mentioned embodiment, the invention was applied to the sheet-handling device 2 attached to the copier 100. However, it needs not be pointed out that the invention can also be applied to a sheet-handling device incorporated in the copier body 102.

The invention claimed is:

1. A sheet-handling device comprising an intermediate tray, an intermediate conveyer passage for guiding a sheet into the intermediate tray, introduction rollers for introducing the sheet into the intermediate conveyer passage, conveying rollers for conveying, into the intermediate tray, the sheet introduced into the intermediate conveyer passage, a holder member for releasably holding the sheet introduced into the intermediate conveyer passage in a manner of being faced to the conveyer surface of the intermediate conveyer passage, holder member drive means for driving the holder member, introduction roller drive means for so driving the introduction rollers as to rotate forward, conveying roller drive means for so driving the conveying rollers as to rotate forward or reverse, and a controller for controlling the drive means;

wherein, when a standby/overlap handling mode is set to select the number of pieces of sheets that are to stand by and are to overlap in the intermediate conveyer passage to be a predetermined number N (=2 pieces) to form a next sheaf of sheets following the preceding sheaf of sheets conveyed into the intermediate tray, the controller so controls the drive means that:

the introduction rollers and the conveying rollers are rotated forward so that a first sheet introduced into the intermediate conveyer passage is nipped at its leading end by the conveying rollers and is conveyed until the trailing end thereof separates away from the introduction rollers and, thereafter, the conveying rollers are halted;

a second sheet is introduced into the intermediate conveyer passage by the introduction rollers in a state where the first sheet is held by the holder member, and the conveying rollers are rotated forward when the leading end of the second sheet has approached a nipping portion of the conveying rollers, so that the leading end of the second sheet is nipped being overlapped on the first sheet that has been nipped already by the conveying rollers, and the sheets of the predetermined number N (=2 pieces) are conveyed in an overlapped manner into the intermediate tray;

wherein the distance between a nipping portion of the introduction rollers and the nipping portion of the conveying rollers is set to be shorter than the length in the direction of conveyance of a sheet of a predetermined size introduced into the intermediate passage;

wherein the holder member can be displaced by a holder member drive means to a holding position where the trailing end of the sheet is held being faced to the conveyer surface and to a release position where the holding is released, wherein the sheet is introduced into the intermediate conveyer passage is nipped at its leading end by the nipping portion of the conveying rollers and its trailing end passes through the nipping portion of the introduction rollers, and wherein the holder member comprises a holder portion to hold the trailing portion of the sheet relatively movable to the conveyer surface while maintaining the holder member in the holding position and a passing-through opening being capable of passing through the sheet introduced subsequently in the direction of the conveying rollers while maintaining the holder member in the holding position.

2. A sheet-handling device according to claim 1, wherein the holding member includes a pair of support shafts which extend in the direction of width of the sheet at right angles with a direction in which the sheet is introduced and are so supported as to rotate on the same axis maintaining a distance in the direction of the width, a pair of arms extending in parallel from the support shafts, and a holder portion extending across the arms in parallel with the axis, wherein the distance between the arms in the direction of the width is set to be greater than the size of the sheet in the direction of width, the holder portion is separated from the conveyer surface up to a position where the leading end of the sheet that is introduced does not interfere therewith in a state where the holder member is displaced to the release position, the holder portion is brought to a position where the leading end of the sheet that is introduced does not interfere therewith in a state where the holder member is displaced to the holding position, and the arms are so positioned that the sheet that is introduced is allowed to be conveyed toward the conveying rollers passing through between the arms without interfering therewith.

3. A sheet-handling device according to claim 1, wherein a movable guide member is arranged in the intermediate conveyer passage at a position just downstream of the introduction rollers so as to be displaced by an actuator to a first position for guiding a sheet of the predetermined size that is introduced toward the conveying rollers and to a second position for guiding a sheet of a particular size greater than the predetermined size that is introduced toward the intermediate tray, the movable guide member constituting a portion of the conveyer surface of the intermediate conveyer passage.

4. A sheet-handling device comprising an intermediate tray, an intermediate conveyer passage for guiding a sheet into the intermediate tray, introduction rollers for introducing the sheet into the intermediate conveyer passage, conveying rollers for conveying, into the intermediate tray, the sheet introduced into the intermediate conveyer passage, a holder member for releasably holding the sheet introduced into the intermediate conveyer passage in a manner of being faced to the conveyer surface of the intermediate conveyer passage, holder member drive means for driving the holder member, introduction roller drive means for so driving the introduction rollers as to rotate forward, conveying roller drive means for so driving the conveying rollers as to rotate forward or reverse, and a controller for controlling the drive means;

wherein, when a standby/overlap handling mode is set to select the number of pieces of sheets that are to stand by and are to overlap in the intermediate conveyer passage to be a predetermined number N which is equal to or more than three pieces to form a next sheaf of sheets following the preceding sheaf of sheets introduced into the intermediate tray, the controller so controls the drive means that:

the introduction rollers and the conveying rollers are rotated forward so that a first sheet introduced into the intermediate conveyer passage is nipped at its leading end by the conveying rollers and is conveyed until the trailing end thereof separates away from the introduction rollers and, thereafter, the conveying rollers are halted;

the conveying rollers are rotated forward for a second or subsequent sheet, except an N-th sheet, successively introduced by the introduction rollers into the intermediate conveyer passage when the leading end thereof has approached the nipping portion of the conveying rollers in a state that a sheet introduced to the intermediate conveyer passage prior to the sheet is being held by the holding member, so that the leading end is nipped by the conveying rollers and, after having conveyed the sheet until the trailing end separates away from the introduction rollers and passes through the holder portion of the holder member, the conveying rollers are halted, the holding by the holder member is released, the conveying rollers are rotated reverse, and the sheet is moved back while being held again by the holder member and is halted in a state where the leading end is nipped;

finally, the N-th sheet is introduced by the introduction rollers into the intermediate conveyer passage in a state where the (N−1)-th sheet is held by the holder member, and the conveying rollers are rotated forward when the leading end of the N-th sheet has approached a nipping portion of the conveying rollers, so that the leading end of the N-th sheet is nipped being overlapped on the (N−1)-th sheet that has been nipped already by the conveying rollers, and the sheets of the predetermined number N are conveyed in an overlapped manner into the intermediate tray;

wherein the distance between a nipping portion of the introduction rollers and the nipping portion of the conveying rollers is set to be shorter than the length in the direction of conveyance of a sheet of a predetermined size introduced into the intermediate passage;

wherein the holder member can be displaced by a holder member drive means to a holding position where the trailing end of the sheet is held being faced to the conveyer surface and to a release position where the holding is released, wherein the sheet is introduced into the intermediate conveyer passage is nipped at its leading end by the nipping portion of the conveying rollers and its trailing end passes through the nipping portion of the introduction rollers, and wherein the holder member comprises a holder portion to hold the trailing portion of the sheet relatively movable to the conveyer surface while maintaining the holder member in the holding position and a passing-through opening being capable of passing through the sheet introduced subsequently in the direction of the conveying rollers while maintaining the holder member in the holding position.

5. A sheet-handling device according to claim 4, wherein the holding member includes a pair of support shafts which extend in the direction of width of the sheet at right angles with a direction in which the sheet is introduced and are so supported as to rotate on the same axis maintaining a distance in the direction of the width, a pair of arms extending in parallel from the support shafts, and a holder portion extending across the arms in parallel with the axis, wherein the distance between the arms in the direction of the width is set to be greater than the size of the sheet in the direction of width, the holder portion is separated from the conveyer surface up to a position where the leading end of the sheet that is introduced does not interfere therewith in a state where the holder member is displaced to the release position, the holder portion is brought to a position where the leading end of the sheet that is introduced does not interfere therewith in a state where the holder member is displaced to the holding position, and the arms are so positioned that the sheet that is introduced is allowed to be conveyed toward the conveying rollers passing through between the arms without interfering therewith.

6. A sheet-handling device according to claim 4, wherein a movable guide member is arranged in the intermediate conveyer passage at a position just downstream of the introduction rollers so as to be displaced by an actuator to a first position for guiding a sheet of the predetermined size that is introduced toward the conveying rollers and to a second position for guiding a sheet of a particular size greater than the predetermined size that is introduced toward the intermediate tray, the movable guide member constituting a portion of the conveyer surface of the intermediate conveyer passage.

7. A sheet-handling device comprising an intermediate tray wherein a sheaf of sheets undergoes a predetermined sheet-handling and is moved to the direction of discharge, an intermediate conveyer passage comprising conveying rollers wherein a preceding sheet of the plurality of sheets being introduced continuously into the intermediate conveyer passage is positioned to wait a predetermined standby position and then, a sheet conveyed subsequently is overlapped with the preceding sheet to convey the plurality of sheets overlapped to the intermediate tray, and a holder member being so arranged in the intermediate conveyer passage as to rotate between a release position most distant from the conveyer surface of the intermediate conveyer passage and a holding position holding the trailing portion of the sheet which is once being waited at the predetermined standby position relatively movable to the conveyer surface, wherein the holder member comprises a holder portion to hold the trailing portion of the sheet in a state relatively movable to the conveyer surface and a pair of arms extending off said holder portion and said arms being spaced apart and positioned as to define a passing-through opening that is capable of providing for a passing through of the sheet introduced subsequently in the direction of the conveying rollers between said arms while maintaining the holder portion in the holding position.

* * * * *